US007752857B2

(12) United States Patent
Wakamoto et al.

(10) Patent No.: US 7,752,857 B2
(45) Date of Patent: Jul. 13, 2010

(54) REFRIGERATOR AND AIR CONDITIONER

(75) Inventors: Shinichi Wakamoto, Tokyo (JP); Toshihide Kouda, Tokyo (JP); Masahiro Sugihara, Kobe (JP); Fumitake Unezaki, Tokyo (JP); Masayuki Kakuta, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/391,378

(22) Filed: Feb. 24, 2009

(65) Prior Publication Data

US 2009/0158761 A1 Jun. 25, 2009

Related U.S. Application Data

(62) Division of application No. 10/579,100, filed as application No. PCT/JP2004/017458 on Nov. 25, 2004, now Pat. No. 7,526,924.

(30) Foreign Application Priority Data

Nov. 28, 2003 (JP) ..... 2003-398271

(51) Int. Cl.
*F25B 13/00* (2006.01)

(52) U.S. Cl. ..... 62/175; 62/324.1; 62/324.6

(58) Field of Classification Search ..... 62/175, 62/324.1, 324.6, 335
See application file for complete search history.

(56) References Cited

U.S. PATENT DOCUMENTS 4,149,389 A * 4/1979 Hayes et al. ..... 62/79
4,157,649 A * 6/1979 Bussjager et al. ..... 62/81
4,391,104 A 7/1983 Wendschlag
4,949,547 A * 8/1990 Shimizu ..... 62/79
6,260,367 B1 7/2001 Furuya et al.
6,405,554 B1 6/2002 Kawakatu et al.
6,529,133 B2 3/2003 Tamaoki et al.
6,557,361 B1 5/2003 Howard
6,796,139 B2 9/2004 Briley et al.

FOREIGN PATENT DOCUMENTS

JP 55-17451 U 12/1980
JP 56-20960 A 2/1981
JP 57-198965 A 12/1982
JP 59-120876 U 8/1984
JP 1-144770 U 10/1989
JP 10-54617 A 2/1998
JP 2001-56157 A 2/2001
JP 2001-91074 A 4/2001
JP 2001-235340 A 8/2001
JP 2001-304714 A 10/2001
JP 2001-317820 A 11/2001
JP 2002-107044 A 4/2002
JP 2002-286310 A 10/2002

* cited by examiner

*Primary Examiner*—William E Tapolcai
(74) *Attorney, Agent, or Firm*—Leydig, Voit & Mayer, Ltd.

(57) ABSTRACT

A refrigerator has a coolant cooler for cooling a coolant at the entrance of a flow control valve, when the cooling amount in the coolant cooler is deficient as well as excessive. The refrigerator includes a compressor for compressing the coolant, a radiator for radiating heat from the coolant, a coolant cooler for cooling the coolant, a flow control valve for regulating the flow volume of the coolant, an evaporator for evaporating the coolant, and a heat-exchange-amount control for controlling the amount of heat exchanged in the coolant cooler. The coolant is circulated through the compressor, the radiator, the coolant cooler, the flow control valve, and the evaporator, in that sequence.

11 Claims, 25 Drawing Sheets

REFRIGERATOR AND AIR CONDITIONER

TECHNICAL FIELD

The present invention relates to refrigerators used in freezers, refrigerating chambers, ice-makers, water-coolers, and air conditioners having cooling functions, etc., and to air conditioners for cooling and warming.

BACKGROUND ART

In conventional refrigerators and air conditioners for cooling and warming air configured of compressors, radiators, flow control valves, and evaporators, which are connected by coolant pipes and configured in such a way that a hydrofluorocarbon coolant (hereinafter referred to as an HFC coolant) circulates, the global warming potential of the HFC coolant is relatively large, which cause evil effects of the global warming.

Refrigerators and air conditioners for cooling and warming are now developed using a hydrocarbon coolant (hereinafter referred to as an HC coolant) such as propane, ammonia, and carbon dioxide, whose global warming potential values are lower than that of chlorofluorocarbon. When the HC coolant or ammonia is used, because these coolants are flammable, measures not to ignite themselves are needed; therefore, the usage is limited by the law. Although carbon dioxide is nonflammable, a problem is included in which the coefficient of performance (hereinafter referred to as the COP) deteriorates.

In a case of an air conditioner as an example of a refrigerator using carbon dioxide as a coolant, the reason is explained why the COP deteriorates when carbon dioxide is used as the coolant. An air conditioner has cooling/warming rate conditions that define atmospheric temperatures. In a cooling operation, when dry-bulb temperature is 35 degrees outside a room, the dry-bulb temperature is 27 degrees and wet-bulb temperature is 19 degrees inside the room. In a warming operation, when the dry-bulb temperature is 7 degrees and the wet-bulb temperature is 6 degrees outside the room, the dry-bulb temperature is 20 degrees inside the room. In a case in which carbon dioxide is used as the coolant, the COP in a cooling rate condition especially deteriorates under the outdoor temperature being relatively high. This phenomenon is caused by the coolant temperature increasing up to not lower than 35 degrees at the exit of a heat exchanger placed outside the room, because the dry-bulb temperature outside the room is 35 degrees. When carbon dioxide expands from the super critical state, a region in which the specific heat is relatively large exists in approximately from 10 to 60 degrees; however, in a state in which the dry-bulb temperature outside the room is 35 degrees, because the entire of the region in which the specific heat is relatively large cannot be used, the energy consumption efficiency decreases. On the other hand, when the HFC coolant or the HC coolant is used, heat exchange is possible in which the coolant vapor can be wholly changed into the coolant liquid under the cooling rate condition; therefore, the COP is more improved than that in the case of carbon dioxide.

A conventional air conditioner using carbon dioxide as a coolant is disclosed, in which a coolant cooling means composed of a cooling heat-exchanger, using a low-temperature heat source including water, ice-water, and seawater, is provided, and by sequentially connecting, using coolant pipes, a compressor, a radiator, the coolant cooling means, a flow control valve, and an evaporator, the coolant is circulated. This objective is to improve the COP by decreasing, using the coolant cooling means, the coolant temperature at the entrance of the flow control valve (for example, referring to Patent Document 1).

As a cooling means for cooling the coolant at the entrance of the flow control valve, some power is needed as the cooling means, when water or seawater, etc. in which the power is not needed cannot be used. This power is increased corresponding to the cooling ability of the cooling means. Therefore, considering the sum of the power needed for the compressor and the cooling means that are provided in the air conditioner, overcooling causes the increase of the power needed for the cooling means; consequently, the COP deteriorates. When the cooling is insufficient, the power needed for the compressor of the air conditioner increases; as a result, the COP deteriorates.

[Patent Document 1] Japanese Laid-Open Patent Publication 54,617/1998.

DISCLOSURE OF THE INVENTION

Although the explanation has been made with respect to the case where the refrigerator is applied to the air conditioner, when the refrigerator is used in a freezer, a refrigerating chamber, an ice-maker, or a watercooler, the explanation is similar to that.

An objective of the present invention is to improve the COP in a refrigerator and an air conditioner having a cooling and a warming functions in which a nonflammable coolant such as carbon dioxide is used whose global warming potential is lower than that of chlorofluorocarbon, and a cooling means is provided for cooling, using energy, the coolant at the entrance of a flow-control valve.

A refrigerator according to the present invention includes a compressor for compressing a coolant, a radiator for radiating heat from the coolant, a coolant cooling means for cooling the coolant, a flow control valve for regulating the flow volume of the coolant, an evaporator for evaporating the coolant, and a heat-exchange-amount control means for controlling the amount of heat exchanged in the coolant cooling means, wherein the coolant is circulated through the compressor, the radiator, the coolant cooling means, the flow control valve, and the evaporator, in that sequence.

An air conditioner according to the present invention includes a compressor for compressing a coolant, a four-way valve for switching the direction in which the coolant as outputted from the compressor flows, an outdoor heat exchanger for exchanging heat between the coolant and outdoor air, a coolant cooling/heating means for cooling as well as heating the coolant, a flow control valve for regulating the flow volume of the coolant, an indoor heat exchanger for exchanging heat between the coolant and indoor air, and a heat-exchange-amount control means for controlling the amount of heat exchanged in the coolant cooling/heating means, wherein when the air conditioner is being operated for cooling, the coolant is circulated through the compressor, the outdoor heat exchanger, the coolant cooling/heating means, the flow control valve, and the indoor heat exchanger, in that sequence, and when the air conditioner is being operated for warming, the coolant is circulated through the compressor, the indoor heat exchanger, the flow control valve, the coolant cooling/heating means, and the outdoor heat exchanger, in that sequence.

The refrigerator according to the present invention includes the compressor for compressing the coolant, the radiator for radiating the heat from the coolant, the coolant cooling means for cooling the coolant, the flow control valve for regulating the flow volume of the coolant, the evaporator for evaporating the coolant, and the heat-exchange-amount control means for controlling the amount of the heat exchanged in the coolant cooling means, wherein the coolant is circulated through the compressor, the radiator, the coolant cooling means, the flow control valve, and the evaporator, in that sequence; therefore, the efficiency can be suitably improved.

The air conditioner according to the present invention includes the compressor for compressing the coolant, the four-way valve for switching the direction in which the coolant as outputted from the compressor flows, the outdoor heat exchanger for exchanging the heat between the coolant and outdoor air, the coolant cooling/heating means for cooling as well as heating the coolant, the flow control valve for regulating the flow volume of the coolant, the indoor heat exchanger for exchanging the heat between the coolant and indoor air, and the heat-exchange-amount control means for controlling the amount of the heat exchanged in the coolant cooling/heating means, wherein when the air conditioner is being operated for cooling, the coolant is circulated through the compressor, the outdoor heat exchanger, the coolant cooling/heating means, the flow control valve, and the indoor heat exchanger, in that sequence, and when the air conditioner is being operated for warming, the coolant is circulated through the compressor, the indoor heat exchanger, the flow control valve, the coolant cooling/heating means, and the outdoor heat exchanger, in that sequence; therefore, the efficiency can be suitably improved.

BEST MODE FOR CARRYING OUT THE INVENTION

Embodiment 1

Figure 1:
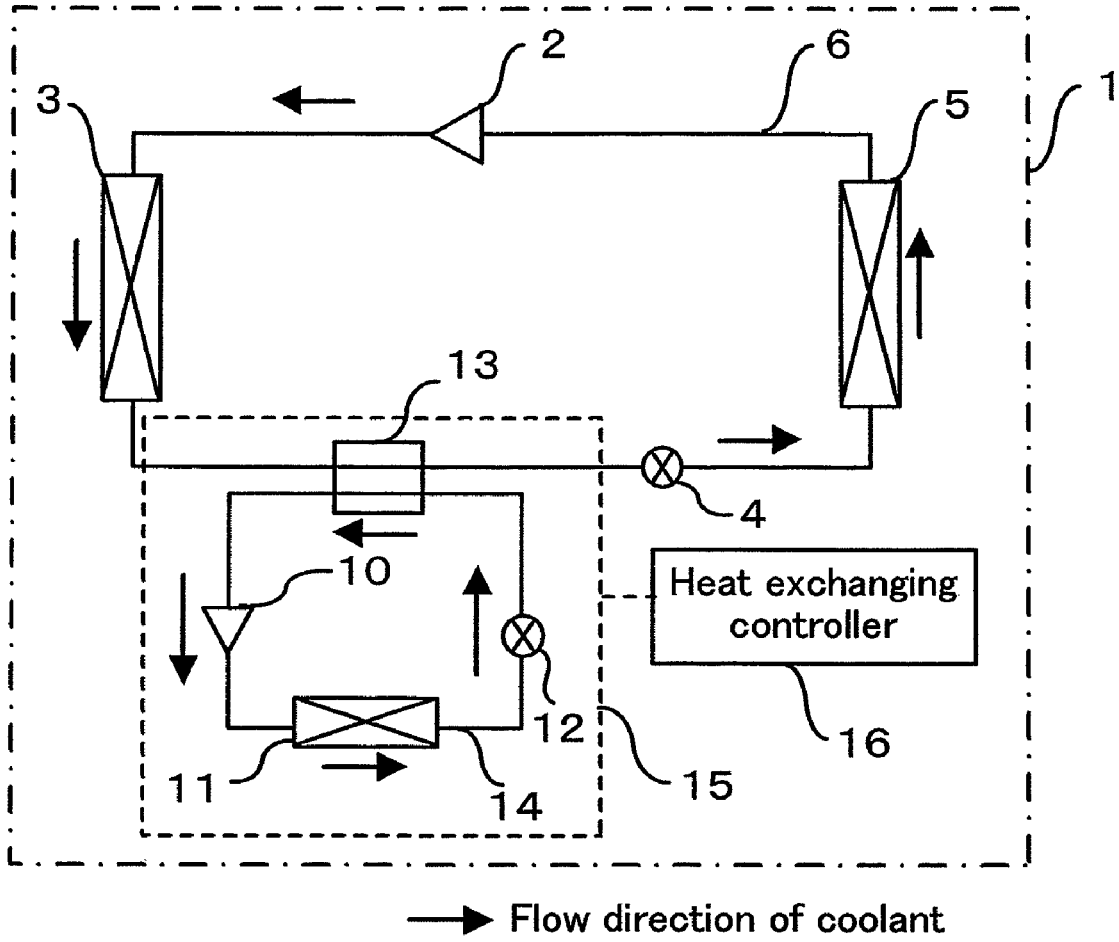
FIG. 1 is a coolant-circuit diagram explaining a configuration of an air conditioner according to Embodiment 1 of the present invention.
Figure 2:
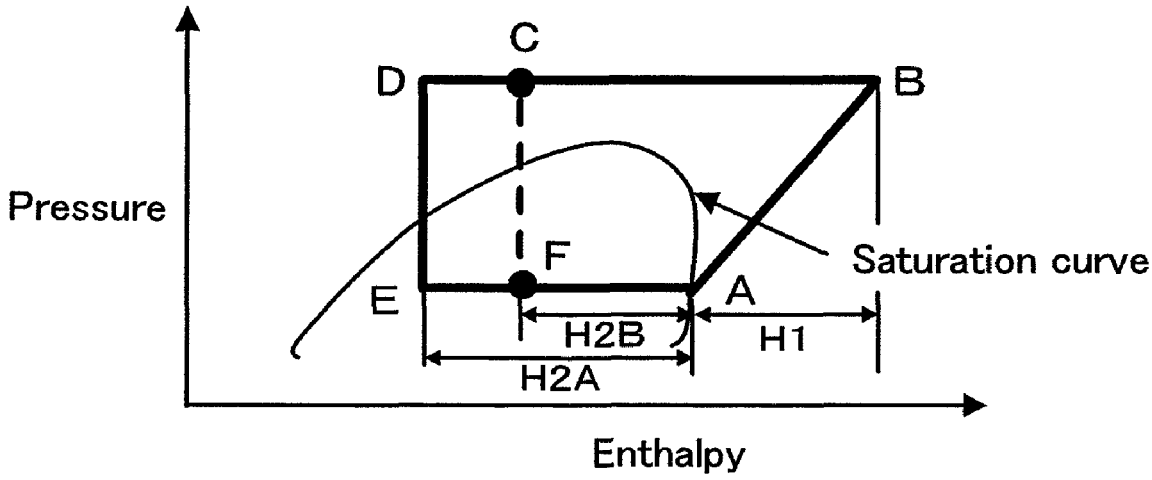
FIG. 2 is a pressure-enthalpy chart explaining the variation of coolant states in the air conditioner according to Embodiment 1 of the present invention.
Figure 3:
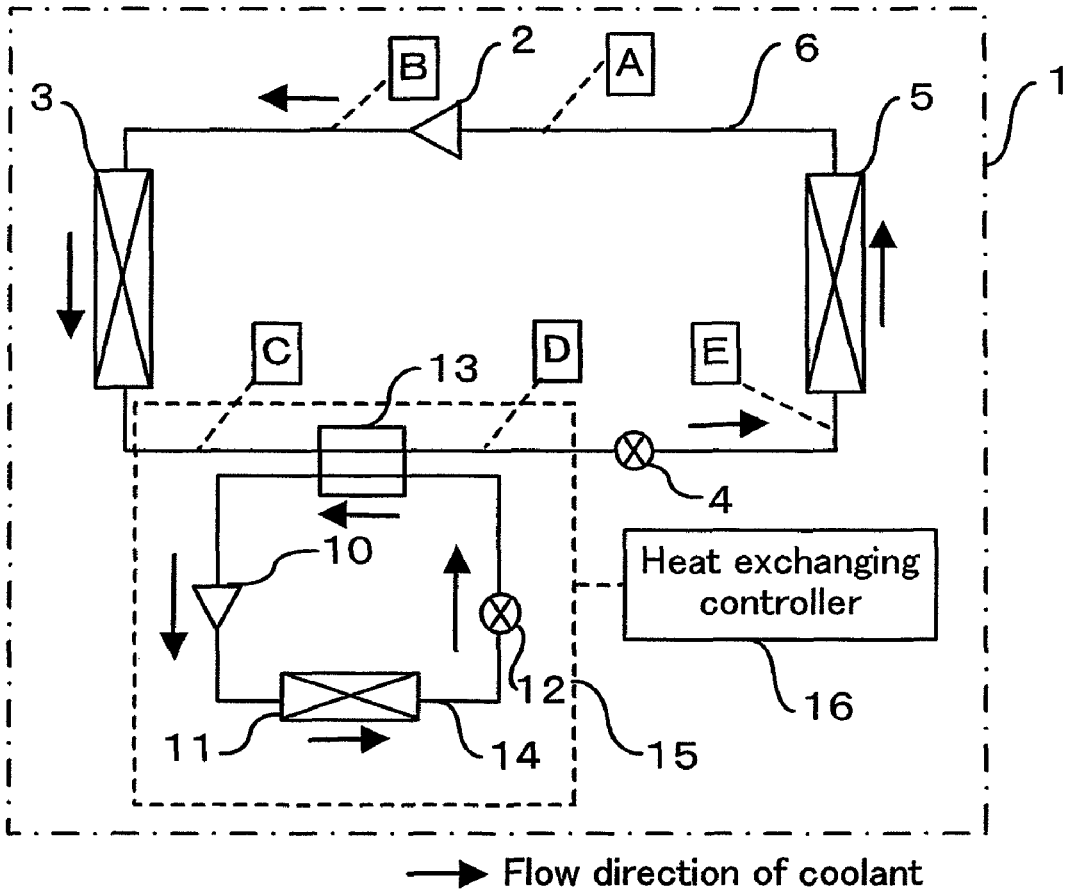
FIG. 3 is a view for explaining each position corresponding to respective coolant states in the coolant-circuit diagram according to Embodiment 1 of the present invention.
Figure 4:
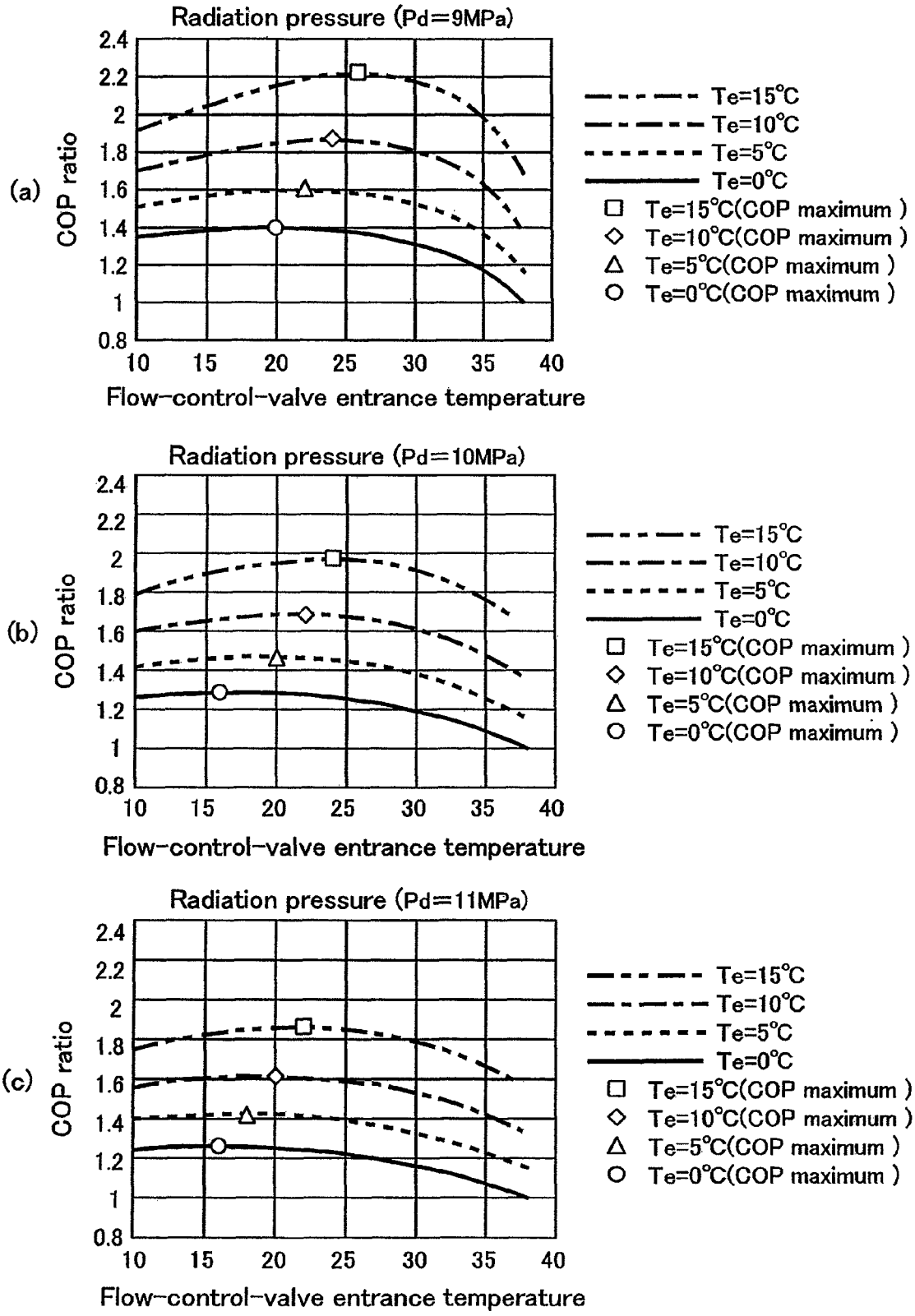
FIG. 4 represents calculation results in which the COP improvement ratios are simulated under cooling rate conditions each corresponding to respective coolant temperatures at the entrance of a flow control valve provided in the air conditioner according to Embodiment 1 of the present invention.
Figure 5:
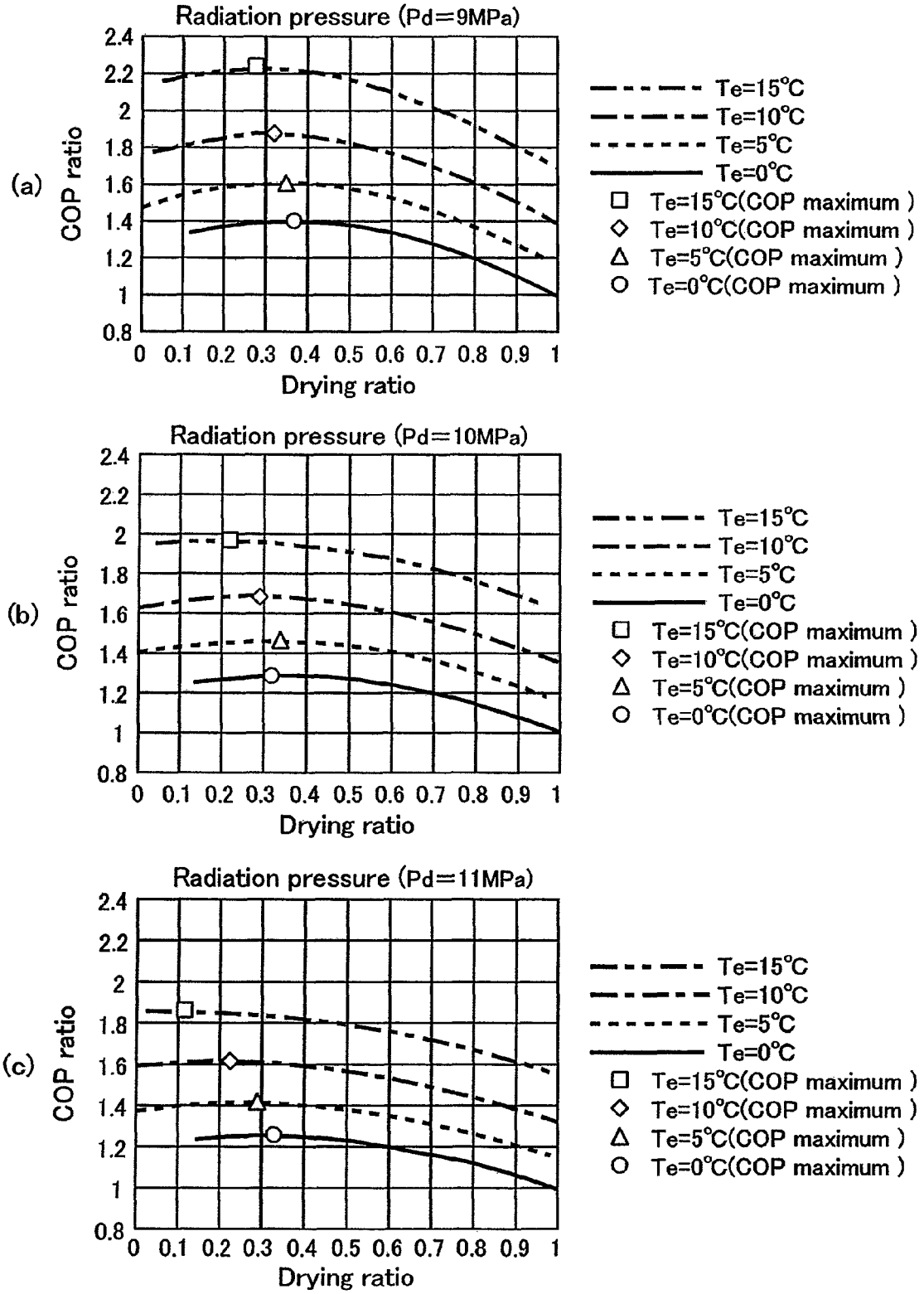
FIG. 5 represents calculation results in which the COP improvement ratios are simulated under cooling rate conditions each corresponding to respective drying ratios that are ratios of coolant drying rates at the entrance of an evaporator and drying rates at the exit of a radiator, when the coolant is decompressed up to the coolant evaporation temperature, that are provided in the air conditioner according to Embodiment 1 of the present invention.

Embodiment 1 according to the present invention is explained using FIG. 1-FIG. 5. FIG. 1 is a coolant-circuit diagram explaining a configuration of a cooling only air conditioner according to Embodiment 1. FIG. 2 is a pressure-enthalpy chart explaining the variation of coolant states. In FIG. 3, each position corresponding to respective coolant states in the coolant-circuit diagram is explained. FIG. 4 represents calculation results in which the COP improvement ratios are simulated under cooling rate conditions each corresponding to respective coolant temperatures at the entrance of a flow control valve 4. FIG. 5 represents calculation results in which the COP improvement ratios are simulated under the cooling rate condition in response to respective drying ratios that are ratios of coolant drying rates at the entrance of an evaporator 5 and drying rates at the exit of a radiator 3 when the coolant is decompressed up to the coolant evaporation temperature.

In FIG. 1, an air conditioner 1 is composed of a compressor 2 as a first compressor for compressing coolant, a radiator 3 as a first radiator for radiating heat from the coolant, a coolant cooler 15 that is a coolant cooling means for cooling the coolant, a flow control valve 4 as a first flow control valve for controlling the coolant flow, and an evaporator 5 as a first evaporator for evaporating the coolant, which are sequentially connected by coolant pipes 6, and is configured in such a way that carbon dioxide as the coolant circulates. In the figure, the coolant flow is represented by arrows. A heat exchanging controller 16 is also provided as a heat-exchanging control means for controlling the heat-exchanging amount in the coolant cooler 15. The coolant that circulates in a vapor-compression refrigeration cycle configured of the compressor 2, etc. is also referred to as a first coolant.

The coolant cooler 15 operates in which propane, as a second coolant, whose energy consumption efficiency is higher than that of carbon dioxide, circulates in a vapor-compression refrigeration cycle. In the coolant cooler 15, a second compressor 10 for compressing the second coolant, a condenser 11 for radiating the heat from the second coolant, a second flow control valve 12 for controlling the second coolant flow, and a second evaporator 13 for evaporating the second coolant using the coolant heat at the entrance of the flow control valve 4 provided in a coolant circulating route are sequentially connected by a second coolant pipes 14. In the figure, the second coolant flow is also represented by arrows.

It is assumed that the cooling ability of the coolant cooler 15 according to the refrigeration cycle using the second coolant is set at approximately from one-tenth to one-fifth of that using the first coolant.

The evaporator 5 is placed inside a room in which air is to be cooled, meanwhile the other units are placed outside the room; then, the coolant pipes 6 are laid so that the coolant circulates among the units. Here, the evaporator 5 may also be placed outdoors, for example, in a railway platform. Regarding the units other than the radiator 3, the evaporator 5, and the condenser 11 that are needed to heat-exchange with air, necessary and sufficient heat insulation is maintained so that the efficiency does not decrease due to heat leakage.

Next, variation of coolant states (exactly, first-coolant states) is explained according to FIG. 2. In the figure, regarding points, such as the point "C", which are not located on the corners of a locus representing the coolant states, their positions are represented by black circles. First, low-temperature low-pressure coolant vapor in the coolant pipe 6 connected to the inlet of the compressor 2 positions at the point "A" in FIG. 2. Although the entire of the coolant at the entrance of the compressor is needed to be vapor, because the higher the temperature of the coolant vapor the more the mechanical input power becomes needed, the overheat rate at the point "A" is set at a predetermined value dose to nil.

When the coolant is compressed by the compressor 2, the coolant is changed to high-temperature high-pressure super-critical fluid as represented by the point "B", and then outputted. The coolant is sent into the radiator 3; then, the temperature of the coolant decreases after heat exchange is performed there with air, etc., and the coolant becomes a state of high-pressure super-critical fluid as represented by the point "C".

The coolant is further cooled by the coolant cooler 15 whose cooling ability is controlled by the heat exchanging controller 16, and the temperature of the coolant decreases; then, the coolant becomes a state as represented by the point "D". Moreover, the coolant flows into the flow control valve 4, and is decompressed therein; then, the coolant changes to a low-temperature low-pressure gas-liquid two-phase state as represented by the point "E". The coolant is sent into the evaporator 5, evaporates there after heat exchange is performed with air, etc., and becomes low-temperature low-pressure coolant vapor as represented by the point "A"; then, the coolant is returned back to the compressor.

When the coolant cooler 15 does not cool the coolant, the coolant as represented by the point "C" in FIG. 2 is flowed into the flow control valve 4 and decompressed; then, the coolant changes to the low-temperature low-pressure gas-liquid two-phase state as represented by the point "F". A locus of the coolant state in which the coolant cooler 15 does not cool the coolant is represented by a broken line. Comparing the locus "A-B-C-D-E-A" when the coolant cooler 15 cools the coolant and the locus "A-B-C-F-A" when the coolant cooler 15 does not cool the coolant, the difference is as follows. Because the enthalpy difference during the locus "A-B" is H1, the mechanical, input power in the compressor is the same in both cases. Regarding the cooling ability, when the coolant cooler 15 cools the coolant, the enthalpy difference during the locus "E-A" is H2A, meanwhile when the coolant cooler 15 does not cool the coolant, the enthalpy difference during the locus "F-A" is H2B. H2A is larger than H2B as obviously represented in FIG. 2; therefore, if the mechanical input power in the coolant cooler 15 is not considered, the more cooling the coolant, the more the COP is improved.

Actually, because the mechanical input power is also needed in the coolant cooler 15, in a range in which the value of the ratio between improved cooling ability due to the coolant being cooled in the coolant cooler 15 and mechanical input power into the coolant cooler 15 is larger than the COP, the more cooling the coolant, the more the COP is improved; meanwhile, if the value of the ratio becomes smaller than the COP value, the COP deteriorates. Thereby, regarding the heat exchange amount, that is, the cooling amount in the coolant cooler 15, the most suitable value for most improving the COP is to exist.

This fact is more quantitatively explained. FIG. 4 is views representing calculation results in which the COP improvement ratios are simulated under cooling rate conditions each corresponding to each coolant temperature at the entrance of the flow control valve 4. FIG. 5 is views representing calculation results in which the COP improvement ratios are simulated under cooling rate conditions each corresponding to each drying ratio, on the horizontal axis, which is a ratio of a coolant drying rate at the entrance of the evaporator 5 and a drying rate at the exit of the radiator 3 when the coolant is decompressed up to the coolant evaporation temperature. The numerator of the drying ratio is the drying rate at the point "E" in FIG. 2, while the denominator is the drying rate at the point "F" in FIG. 2. Here, the drying rate is the ratio of a coolant-vapor component to the coolant in a gas-liquid two-phase state. When only the coolant vapor exists, the drying rate is "1.0"; while when the coolant vapor does not exist, the drying rate is "0.0".

Detailed conditions for the simulation are as follows. In a cooling rate condition, the coolant is carbon dioxide, the efficiency of the compressor 2 is 70%, the inlet-vapor overheat rate of the compressor 2 is 0 degree, the temperature difference between the coolant and air at the exit of the radiator 3 is 3 degrees, the second coolant used in the coolant cooler 15 is propane, the efficiency of the second compressor 10 is 70%, and the condensation temperature in the condenser 11 is 40 degrees.

In FIG. 4, when coolant pressure Pd after compressed by the compressor 2 is assumed that Pd is any one of 9 MPa, 10 MPa and 11 MPa, and coolant temperature Te at the entrance of the evaporator 5 is assumed that Te is any one of 15 degrees, 10 degrees, 5 degrees, and 0 degree, COP improvement ratios are represented, which are values obtained by which COP values when coolant temperature Tf at the entrance of the flow control valve 4 is varied are divided by COP values when, assuming that Te is 0 degree, the coolant is not cooled by the coolant cooler 15, that is, Tf is 38 degrees.

In FIG. 5, when Pd and Te are assumed to be similar to those in FIG. 4, COP improvement ratios are represented, which are values obtained by which COP values when the drying ratio (represented by the parameter X) is varied are divided by COP values when, assuming that Te is 0 degree, the coolant is not cooled by the coolant cooler 15, that is, X is 1.0.

FIG. 4 and FIG. 5 represent that, when the coolant temperature Tf at the entrance of the flow control valve 4 is suitably controlled, the COP is improved approximately 1.3-1.4 times compared with a case in which the coolant is not cooled at all. Moreover, in FIG. 4, when Te is 15 degrees or 10 degrees, in a range in which Tf is 20-30 degrees in any case when Pd is 9 MPa, 10 MPa or 11 MPa, each COP includes a maximum value, and its variation width is narrower than 0.1. When Te is 5 degrees or 0 degree, in a range in which Tf is 15-25 degrees in any case when Pd is 9 MPa, 10 MPa or 11 MPa, each COP includes a maximum value, and its varying width is narrower than 0.1. FIG. 5 represents that, except for a case in which Pd is 11 MPa and Te is 15 degrees, in a range in which the drying ratio X is 0.2-0.5, each COP includes a maximum value, and its varying width is narrower than 0.1. In the case in which Pd is 11 Pa and Te is 15 degrees, when X is nearly equal to 0.1, the COP takes the maximum value, and also in a range in which X is 0.2-0.5, the difference from the maximum value is only approximately 0.2.

In Embodiment 1 according to the present invention, the heat-exchanging amount in the coolant cooling means is controlled by the heat-exchanging control means so that, in a given operating condition, the difference from the maximum value of the COP is within a relatively small predetermined value; thus, the coolant temperature at the entrance of the flow control valve 4 is suitably controlled. By providing the heat-exchanging control means, deterioration in the COP due to the heat-exchanging amount in the coolant cooling means being insufficient or excessive can be prevented. That is, it is surely effective to improve the COP. Moreover, the improved COP value can be set at a value close to that obtained when a coolant such as propane used as the second coolant is used. The second coolant is flammable, or its global warming potential is inferior to that of the first coolant. It is also effective to reduce such second-coolant usage. Furthermore, the coolant circuit of the second coolant can be configured by a dosed loop outside a room; thereby, leakage of the second coolant inside the room can be prevented.

Here, in FIG. 4 and FIG. 5, graphs are drawn assuming that Pd and Te are constant; however, when the heat-exchanging amount is varied in the coolant cooling means, a case also appears in which Pd and Te vary a little bit. Even in such a case, because the heat-exchanging amount can be realized by the coolant cooling means, in which the COP value reaches the maximum in response to the variation of the heat-exchanging amount in the coolant cooling means, if the heat-exchanging amount is controlled in the coolant cooling means so that the COP reaches a value in a predetermined range dose to the maximum, the COP can surely be improved.

In this Embodiment 1, although carbon dioxide has been used as the first coolant, only if the coolant, whose global warming potential is lower than that of chlorofluorocarbon, is nonflammable, a coolant other than the carbon-dioxide one may be used. Although propane has been used as the second coolant, only if a coolant has better energy consumption efficiency than that of the first coolant, the coolant, which is flammable, and whose global warming potential is higher than that of the first coolant, may be used.

As the second coolant, usage of, for example, HFC coolant, HC coolant, and ammonia can be considered. As the coolant cooling means, although the vapor-compression refrigeration cycle using the second coolant is used, an adsorption refrigeration cycle or a means using the Peltier effect, etc. may also be used. In a case in which a low-temperature heat source composed of water, ice-water, and seawater can be used, a coolant cooling means may be used in which, after the cooling using the low-temperature heat source has been performed, the cooling corresponding to the shortage of the cooling amount is performed by a means that consumes energy.

In a case in which the vapor-compression refrigeration cycle using the second coolant is not utilized, when HFC coolant, HC coolant, or ammonia, etc. is also used as the first coolant, by controlling the heat-exchanging amount in the coolant cooling means using the heat-exchanging controlling means, an effect can be obtained in which the COP can surely be improved. Although a single compressor has been used, the present invention can also be applied to a case in which two or more than two compressors are used. Although a single second-compressor has been used, the present invention can also be applied to a case in which two or more than two second-compressors are used.

Although a case in which a refrigerator is used in a cooling only air conditioner has been explained, the refrigerator may be configured to be used in an air conditioner having both cooling and warming functions, a freezer, a refrigerating chamber, an ice-maker, or a water-cooler, etc. As an unnecessary addition, a refrigerator or a cooler means an apparatus that produce a low-temperature atmosphere, and does not mean only an apparatus in which food, etc. is frozen and stored at low temperature. Moreover, an air conditioner having both cooling and warming functions is also included in a refrigerator during a cooling operation. The above is also applied to the other embodiments.

Embodiment 2

Figure 6:
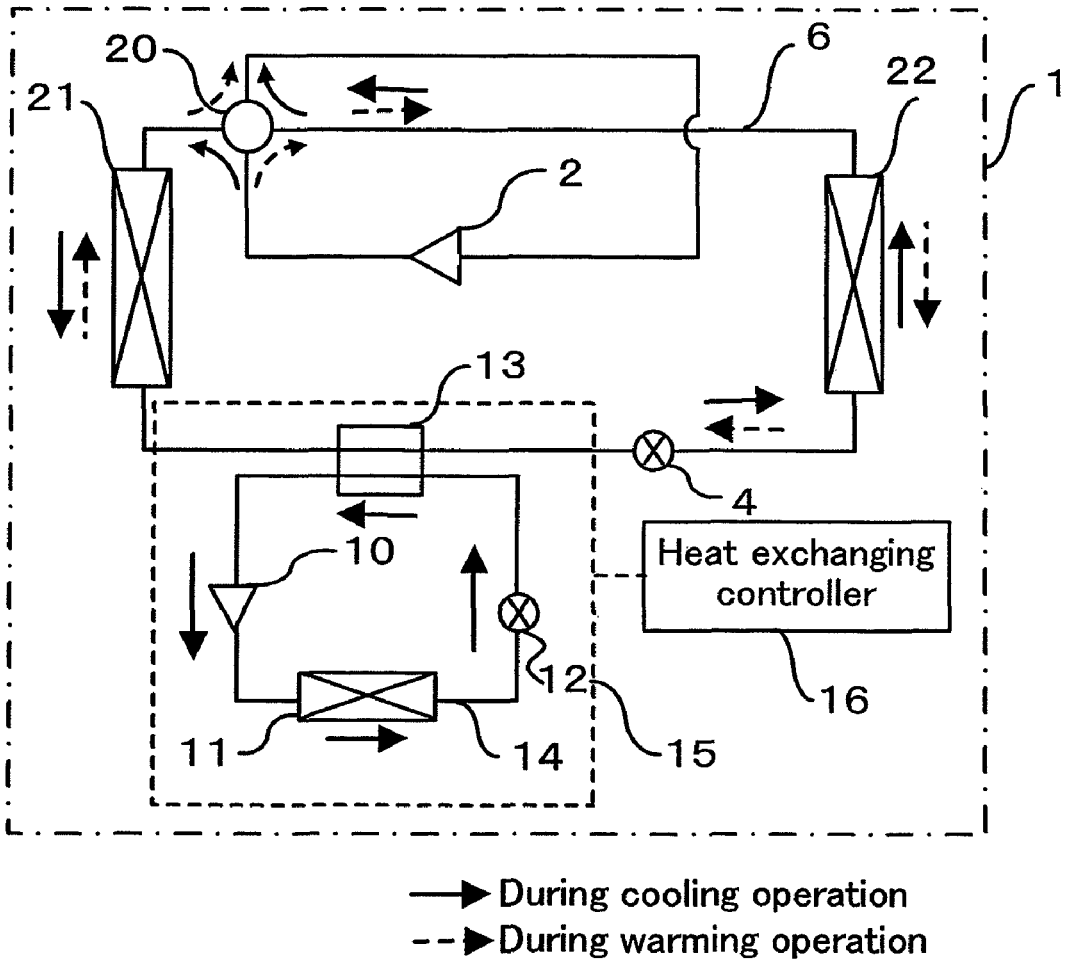
FIG. 6 is a coolant-circuit diagram explaining a configuration of an air conditioner according to Embodiment 2 of the present invention.

In FIG. 6, a coolant-circuit diagram is illustrated for explaining a configuration of an air conditioner having cooling and warming functions according to Embodiment 2 of the present invention. In the figure, coolant flow during a cooling operation is represented by solid-line arrows, meanwhile coolant flow during a warming operation is represented by broken-line arrows.

Only different elements from those in FIG. 1 according to Embodiment 1 that represents a case in which only cooling is performed are explained. A four-way valve 20 as a first four-way valve for switching the flowing directions of the coolant outputted from the compressor 2 is additionally provided, so as to enable both cooling and warming operations. Because, during the warming operation, the radiator 3 and the evaporator 5 operate with their roles being exchanged each other in response to the case of the cooling operation, the radiator 3 is replaced by an outdoor heat exchanger 21 for exchanging heat between the coolant and the outdoor air, and the evaporator 5 is replaced by an indoor heat exchanger 22 for exchanging heat between the coolant and the indoor air. Here, during a cooling operation, the outdoor heat exchanger 21 operates similarly to the radiator 3, meanwhile the indoor heat exchanger 22 operates similarly to the evaporator 5.

By the four-way valve 20, during the cooling operation, the coolant circulates through the compressor 2, the outdoor heat exchanger 21, the coolant cooler 15, the flow control valve 4, and the indoor heat exchanger 22, in that sequence. During the warming operation, the coolant circulates through the compressor 2, the indoor heat exchanger 22, the flow control valve 4, the coolant cooler 15, and the outdoor heat exchanger 21, in that sequence. The other elements are configured similar to those in Embodiment 1.

Next, an operation is explained. First, the radiator 3 and the evaporator 5 are replaced by the outdoor heat exchanger 21 and the indoor heat exchanger 22, respectively; however, the operation during the cooling operation is similar to that in Embodiment 1. A pressure-enthalpy chart explaining the variation of the coolant states also becomes similar to that represented in FIG. 2.

Next, the operation during the warming operation is explained. First, low-temperature low-pressure coolant vapor in the coolant pipe 6 connected to the inlet of the compressor 2 is positioned at the point "A", in FIG. 2, in which the entire coolant is vapor, and the overheat rate drops to a predetermined value dose to nil. After compressed by the compressor 2, the coolant is changed to high-temperature high-pressure super-critical fluid as represented by the point "B", and then, outputted. The outputted coolant is sent through the four-way valve 20 into the indoor heat exchanger 22 as a radiator, and changed to high-pressure super-critical fluid represented by the point "C" after its temperature decreases due to heat exchange so as to warm indoor air. Here, rigorously, the point "C" positions at a point in which the enthalpy is lower than in the case of the cooling operation. The reason is because the indoor temperature during the warming rated operation is 20 degrees, and the temperature is lower than the outdoor temperature of 35 degrees during the cooling rated operation.

The coolant flows into the flow control valve 4, and decompressed there; then, the coolant changes to a low-temperature low-pressure gas-liquid two-phase state represented by the point "F". Because the coolant cooler 15 is not operated during the warming operation, even if the coolant passes through the second evaporator 13 in the coolant cooler 15, the coolant state little changes. Although it is rigorously possible that heat exchange in the second evaporator 13 is performed between the coolant and the second coolant, the heat-exchanging amount is so little as to be negligible. The reason is because the second coolant does not circulate due to stopping of the second compressor 10, calories are difficult to conduct through a thin and long shaped coolant in the coolant pipe due to the thin coolant pipe, and the coolant cooler 15 neither releases nor absorbs calories due to the entire of the coolant cooler 15 being thermally insulated. Also in the other heat exchangers, when at least one of the coolant and the second coolant does not flow, it is assumed that heat is not exchanged.

The coolant is sent into the outdoor heat exchanger 21 as an evaporator, evaporates there after being heat-exchanged with air, etc., and changes to low-temperature low-pressure coolant vapor represented by the point "A". Then, the coolant is returned to the compressor 1 through the four-way valve 20. Compiling the above, the coolant-state varying locus during the warming operation becomes the locus "A-B-C-F-A" in FIG. 2.

Because the coolant cooler 15 stops during the warming operation, the COP value becomes the same as that of a case in which the coolant cooler 15 is not provided.

Also in the configuration of this Embodiment 2, it is effective that the COP can surely be improved, using the heat-exchanging control means, by suitably controlling the heat-exchanging amount in the coolant cooling means during the cooling operation. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a closed loop outside a room; thereby, leakage of the second coolant inside the room can be prevented.

Embodiment 3

Figure 7:
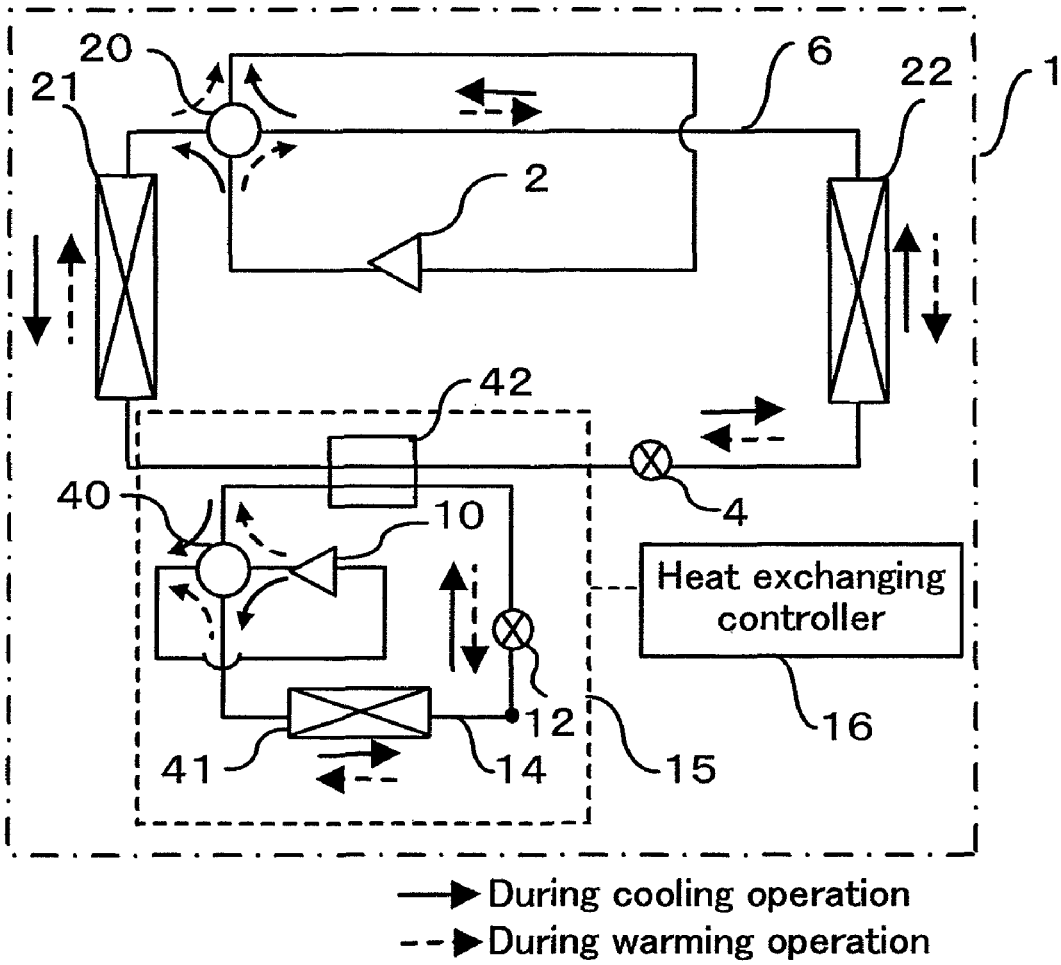
FIG. 7 is a coolant-circuit diagram explaining a configuration of an air conditioner according to Embodiment 3 of the present invention.

FIG. 7 is a coolant-circuit diagram illustrating a configuration of an air conditioner according to Embodiment 3. In Embodiment 3, the coolant cooler 15 in Embodiment 2 is changed to a coolant cooling/heating unit 25 as a coolant cooling/heating means for cooling or heating the coolant.

Only different elements from those in Embodiment 2 are explained. In the coolant cooling/heating unit 25, a second four-way valve 40 for switching the flowing directions of the second coolant outputted from the second compressor is additionally provided, the condenser 11 is replaced by a first heat exchanger 41 for exchanging heat between the second coolant and the outdoor air, and the second evaporator 13 is replaced by a second heat exchanger 42 for exchanging heat between the coolant and the second coolant so as to cool or heat the coolant. Here, during a cooling operation, the first heat exchanger 41 operates similar to the condenser 11, meanwhile the second heat exchanger 42 operates similar to the second evaporator 13.

By the second four-way valve 40, during a cooling operation, the coolant circulates through the second compressor 10, the first heat exchanger 41, the second flow control valve 12, and the second heat exchanger 42, in that order. During a warming operation, the coolant circulates through the compressor 2, the second heat exchanger 42, the second flow control valve 12, and the first heat exchanger 41, in that order. The other elements are configured similar to those in Embodiment 2.

Figure 8:
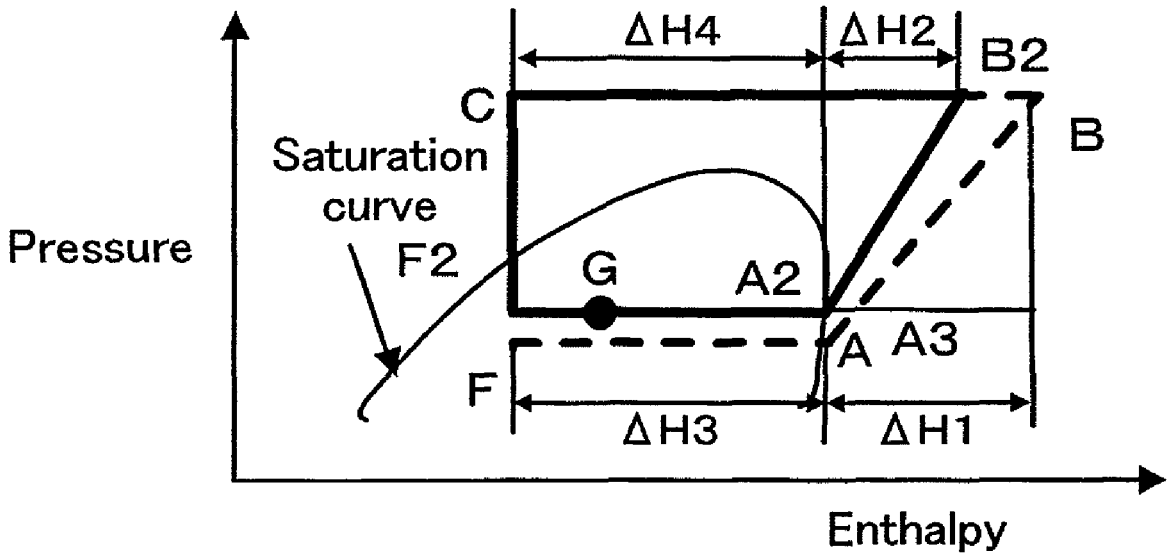
FIG. 8 is a pressure-enthalpy chart explaining, when the air conditioner is being operated for cooling, the variation of coolant states in the air conditioner according to Embodiment 3 of the present invention.

Next, an operation is explained. The operation during a cooling operation is similar to that of the cases in Embodiment 1 and Embodiment 2. During a warming operation, although the coolant cooler 15 has stopped in Embodiment 2, in this Embodiment 3, the coolant cooling heating unit 25 operates so as to heat the coolant. A pressure-enthalpy chart explaining the variation of coolant states, during the warming operation, in the air conditioner according to Embodiment 3 of the present invention is illustrated in FIG. 8. Solid lines represent the case of this Embodiment 3, while broken lines represent the case of Embodiment 2.

The operation during the warming operation becomes as follows. First, the low-temperature low-pressure coolant vapor in the coolant pipe 6 connected to the inlet of the compressor 2 positions at the point "A2", in FIG. 8, in which the entire coolant is vapor, and the overheat rate drops to a predetermined value close to nil. At the point "A2", the pressure is a little higher, while the enthalpy is a little lower than those at the point "A" according to Embodiment 2, and the reason will be explained later. The coolant is compressed by the compressor 2, and then, outputted in a state of high-temperature high-pressure super-critical fluid represented by the point "B2". The pressures at the point "B2" and the point "B" are equivalent, meanwhile the enthalpy at the point "B2" is lower than that at the point "B".

The outputted coolant is sent through the four-way valve 20 into the indoor heat exchanger 22 as a radiator, and changed to the high-pressure super-critical fluid represented by the point "C" after its temperature is decreased by the heat exchanged so as to warm indoor air. Because, in the indoor heat exchanger 22, the heat exchange is performed between the coolant and the indoor air set at a given condition, the point "C" positions at approximately the same position as that in Embodiment 2.

The coolant flows into the flow control valve 4, and changes there to a low-temperature low-pressure gas-liquid two-phase state represented by the point "F2". At the point "F2", the pressure is the same as that at the point "A2", and a little higher than that at the point "F". The coolant is heated by the second heat exchanger 41 in the coolant cooling/heating unit 25, and changed to a state represented by the point "G" as a gas-liquid two-phase state in which coolant vapor increases. The coolant is sent to the outdoor heat exchanger 21 as an evaporator, evaporated there after heat being exchanged with air, etc., changed to low-temperature low-pressure coolant vapor, and returned to the compressor through the four-way valve 20.

Here, the reason is explained, why the coolant pressure outputted from the flow control valve 4, by heating the coolant using the second heat exchanger 41 in the coolant cooling-heating unit 25, becomes higher than that of a case in which the coolant is not heated. By heating the coolant, calories to be absorbed in the outdoor heat exchanger 21 has decreased; thereby, the ability of the outdoor heat exchanger 21 has relatively increased. When the ability of the outdoor heat exchanger 21 increases, the difference between the coolant-vapor temperature and a given outdoor temperature decreases, that is, the evaporation temperature increases. When the evaporation temperature increases, the coolant-vapor pressure also increases.

Next, it is explained that, by heating the coolant using the second heat exchanger 41 in the coolant cooling/heating unit 25, the COP is improved. The COP is assumed to be given by COP1 when the coolant is not heated, and given by COP2 when the coolant is heated. Moreover, the enthalpy difference between those at the points "B" and "A" is assumed to be given by ΔH1, meanwhile the enthalpy difference 3 between those at the points "B2" and "A2" is assumed to be given by ΔH2. The enthalpy difference between those at the points "A" and "C" is assumed to be given by ΔH3, meanwhile the enthalpy difference between those at the points "A2" and "C" is assumed to be given by ΔH4. Here, ΔH1 is mechanical input of the compressor 2 when the coolant is not heated in the coolant cooling/heating unit 25, meanwhile ΔH2 is mechanical input of the compressor 2 when the coolant is heated. Moreover, assuming the efficiency of the outdoor heat exchanger 22 is 100%, ΔH1+ΔH3 becomes calories obtained by the indoor heat exchanger 21 when the coolant is not heated, meanwhile ΔH2+ΔH4 becomes calories obtained by the indoor heat exchanger 21 when the coolant is heated. Therefore, according to the parameter definition the following equations are established.

$$COP1 = (\Delta H1 + \Delta H3)/\Delta H1 \quad \text{(Eq. 1)}$$

$$COP2 = (\Delta H2 + \Delta H4)/\Delta H2 \quad \text{(Eq. 2)}$$

-continued $$\begin{aligned} COP2 - COP1 &= (\Delta H2 + \Delta H4)/\Delta H2 - (\Delta H1 + \Delta H3)/\Delta H1 \\ &= \Delta H4/\Delta H2 - \Delta H3/\Delta H1 \end{aligned} \quad \text{(Eq. 3)}$$

As found in FIG. 8, ΔH3 is nearly equal to ΔH4. When this result is substituted into Eq. 3, the following equation is obtained.

$$COP2 - COP1 \cong (\Delta H3 \times (\Delta H1 - \Delta H2))/(\Delta H1 \times \Delta H2) \quad \text{(Eq. 4)}$$

As found in FIG. 8, because ΔM1 is larger than ΔH2, the right side of Eq. 4 always becomes positive; therefore, the COP is found to be improved by the coolant being heated. The reason why ΔH1 is larger than ΔH2 is explained. First, after the compression is performed at the point "A", a point at which the pressure becomes the same as that at the point "Δ2" is assumed to be the point "Δ3". ΔH1 is divided into mechanical input (referred to as ΔH1A) needed for compressing the coolant from the point "A" to the point "A3" and mechanical input referred to as ΔH1B) needed for compressing it from the point "A3" to the point "B". From the parameter definition, ΔH1 is ΔH1A+ΔH1B. Generally, even if the pressures before and after compression are the same, the larger the enthalpy before compression, the more the mechanical input needed for compressing the coolant increases. Here, the enthalpy at the point "A3" is larger than that at the point "A2". Therefore, ΔH1B is larger than ΔH2. Moreover, because ΔH1A is larger than zero, ΔH1 is larger than ΔH2.

The temperature difference between those of outdoor air and the coolant vapor is essentially several degrees; therefore, the effect has the upper limit, in which the temperature difference is reduced due to the heating amount being increased using the second heat exchanger 41 in the coolant cooling/heating unit 25. The mechanical input needed for increasing the heating amount using the second heat exchanger 41 in the coolant cooling/heating unit 25 increases higher than the linear correlation corresponding to the heating amount. Thereby, when the heating amount increases, the COP deteriorates. An improvement effect of the COP during the warming operation is less than that during the cooling operation. The capacity of the cooling cycle in which the second coolant is used is approximately from one-tenth to one-fifth of the first-coolant cooling cycle; although quantitative data is not represented, in an operational condition in which the cooling cycle using the second coolant effectively operates, the COP falls dose to the maximum value.

In the configuration of this Embodiment 3, it is also effective that, by suitably controlling the heat-exchanging amount in the coolant cooling/heating means, during the cooling operation, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a closed loop outside a room; thereby, leakage of the second coolant inside the room can be prevented.

Furthermore, it is also effective that the COP during the warming operation can be improved.

Embodiment 4

Figure 9:
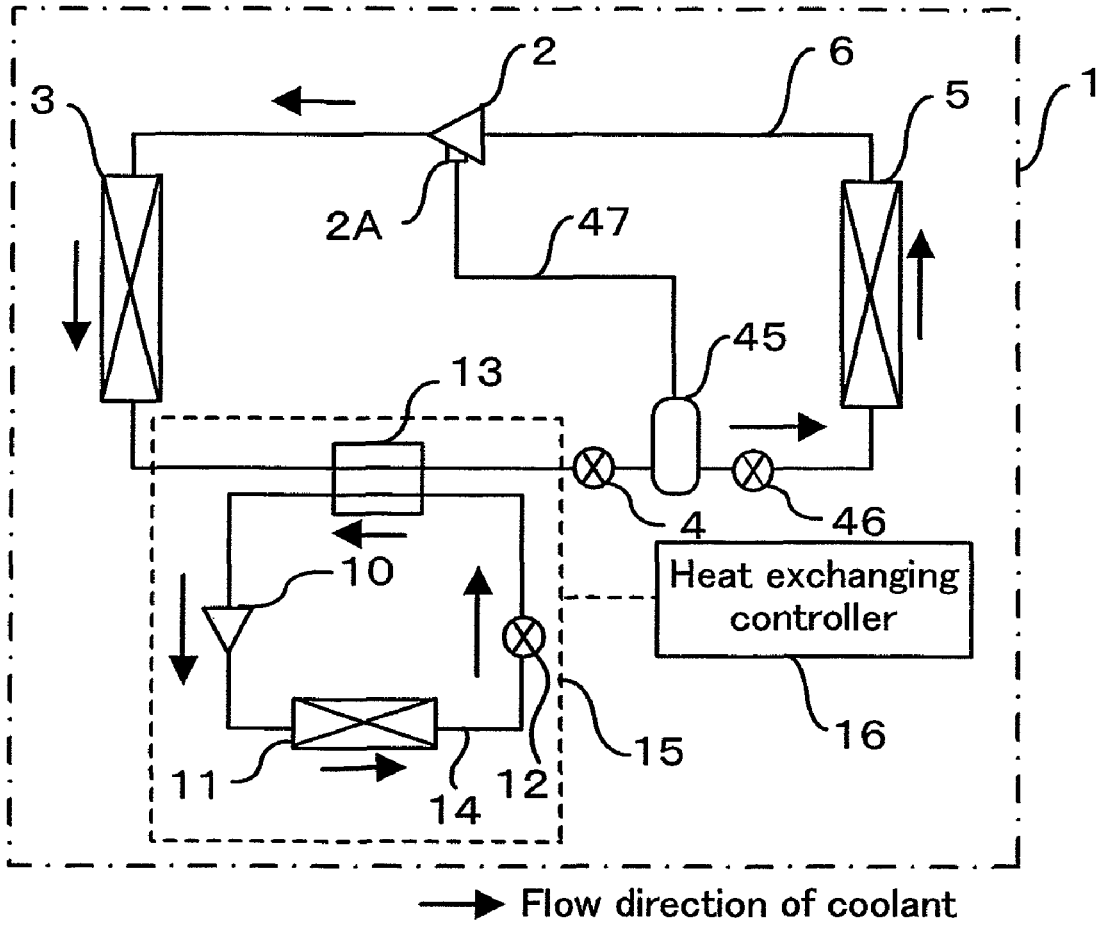
FIG. 9 is a coolant-circuit diagram explaining a configuration of an air conditioner according to Embodiment 4 of the present invention.

FIG. 9 is a coolant-circuit diagram illustrating a configuration of an air conditioner according to Embodiment 4. In Embodiment 4, Embodiment 1 is modified so that the flow volume of the coolant vapor flowing into the evaporator 5 is decreased. Only different elements comparing with those in FIG. 1 according to Embodiment 1 are explained. In FIG. 9, a gas-liquid separator 45 and a third flow control valve 46 are provided on the route from the flow control valve 4 to the evaporator 5, and a bypass pipe 47 is provided for inputting into the compressor 2 part or all of the coolant vapor separated by the gas-liquid separator 45. The compressor 2 has an intermediary-pressure inlet 2A for drawing in the coolant during compressing. The other elements are configured similarly to those in Embodiment 1.

Next, coolant flow is explained using FIG. 9. Regarding the gas-liquid two-phase-state coolant decompressed by the flow control valve 4, part or all of the coolant vapor is separated by the gas-liquid separator 45, passes through the coolant circuit constituted by the bypass pipe 47, is inhaled into the intermediary-pressure inlet 2A of the compressor 2, and is mixed with the coolant inside the compressor 2. The other coolant flow is similar to that in Embodiment 1.

In the configuration of this Embodiment 4, it is also effective that, by suitably controlling the heat-exchanging amount in the coolant cooling means using the heat-exchanging control means, the COP can surely be improved. Here, regarding the variation of the COP corresponding to the variation of the temperature at the entrance of the flow control valve and the variation of the drying ratio, etc., the tendencies are similar to those in Embodiment 1; however, because the configuration of the coolant circuit is differed from that in Embodiment 1, actual values are different from those represented in FIG. 4 or FIG. 5. These facts are also applied to the other embodiments in which the configurations are differed from each other. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a dosed loop outside a room; thereby, leakage of the second coolant inside the room can be prevented.

According to this configuration, because the coolant inside the compressor 2 can be cooled, the power needed for compressing can be reduced. Moreover, because coolant vapor flow flowing through the evaporator 5 is relatively less, the coolant pressure loss in the evaporator can be reduced. Accordingly, in the air conditioner using the first coolant, the efficiency can be further improved. Instead of the compressor 2 having the intermediary-pressure inlet 2A, double compressors may be used by connecting them in series so that the bypass pipe 47 is connected to the coolant pipe 6 connected at the inlet of the high-pressure-side compressor.

Here, in this Embodiment 4, although a case in which the configuration is applied to that in Embodiment 1 has been explained, in a case in which the configuration is applied to Embodiment 2 or Embodiment 3, an effect similar to that can also be obtained.

Embodiment 5

Figure 10:
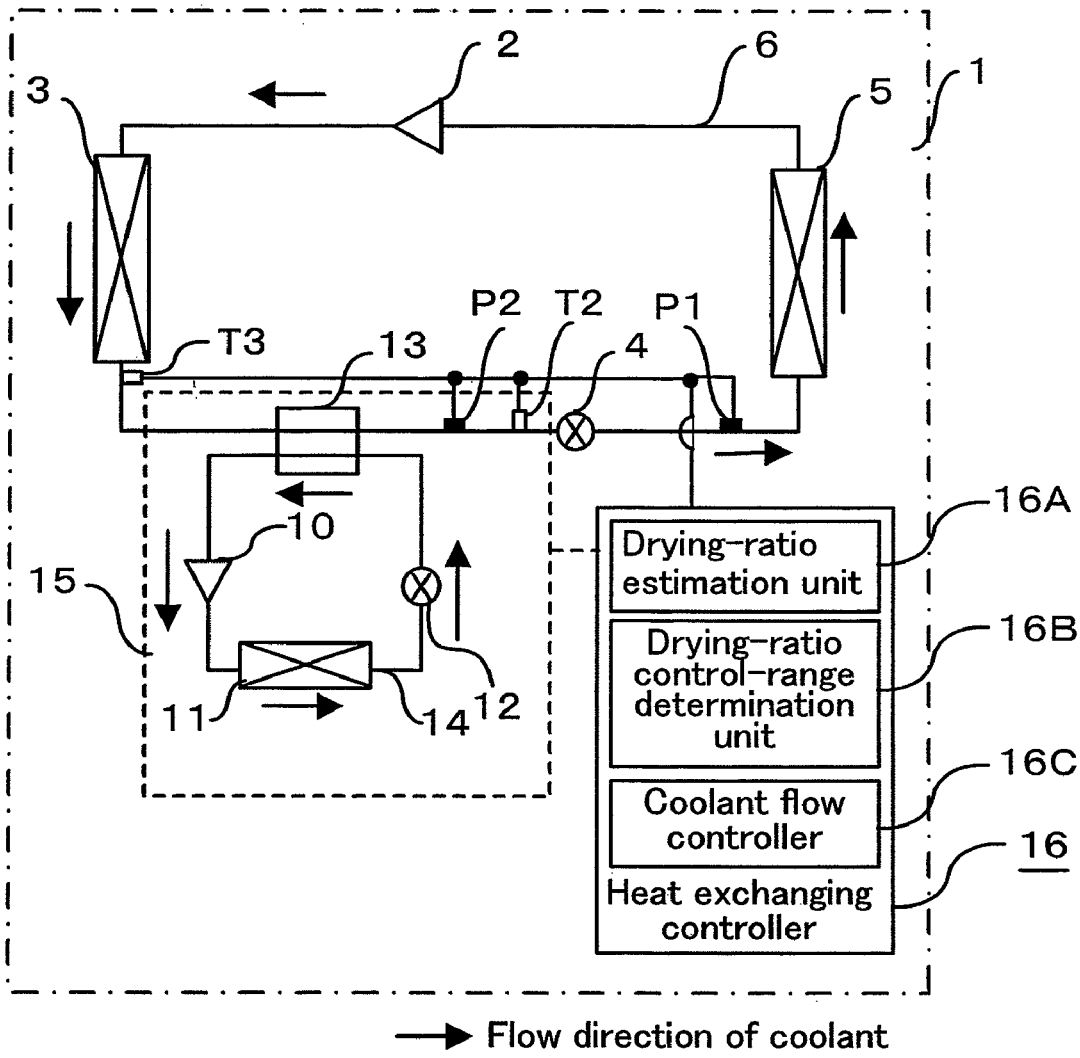
FIG. 10 is a coolant-circuit diagram explaining a configuration of an air conditioner according to Embodiment 5 of the present invention.

FIG. 10 is a coolant-circuit diagram illustrating a configuration of an air conditioner according to Embodiment 5. In Embodiment 5, Embodiment 1 is modified so that a specific means for controlling the drying ratio is provided in the heat exchanging controller 16. Only different elements comparing with those in FIG. 1 according to Embodiment 1 are explained.

In FIG. 10, a pressure gauge P1 as a first pressure measurement means provided at the exit of the flow control valve 4, a pressure gauge P2 as a second pressure measurement means provided at the entrance of the flow control valve 4, a thermometer T2 as a second temperature measurement means provided at the entrance of the flow control valve 4, and a thermometer T3 as a third temperature measurement means provided at the exit of the radiator 3 are additionally provided. Moreover, the heat exchanging controller 16 is configured of a drying-ratio estimation unit 16A as a drying-ratio estimation means for estimating the drying ratio based on the measurement values inputted by the pressure gauge P1, the pressure gauge P2, the thermometer T2, and the thermometer T3, as the given sensors, a drying-ratio control-range determination unit 16B as a drying-ratio control-range determination means for obtaining a control range of the drying ratio in which the difference between each COP when the drying ratio is varied and the maximum value of the COP is within a predetermined range, and a coolant flow controller 16C as a control means for controlling the coolant flow so that the drying ratio is within the control range obtained by the drying-ratio control-range determination unit 16B. The coolant flow controller 16C can control an operational frequency of the second compressor 10 and a command value of the second flow control valve 12.

The other configurations are similar to those of the case in Embodiment 1.

Figure 11:
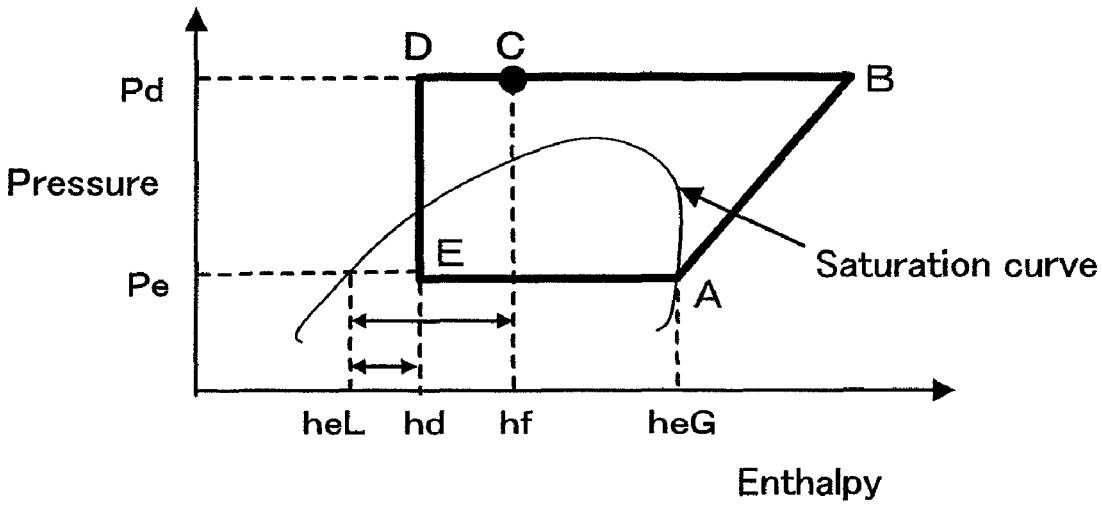
FIG. 11 is a view for explaining parameters used in a process in which drying ratios are estimated in Embodiment 5 of the present invention.

Next, an operation is explained. The coolant flow is similar to that of the case in Embodiment 1. Here, an operation of the heat exchanging controller 16 is explained. The drying-ratio estimation unit 16A estimates as below a drying ratio from each measurement value by the pressure gauge P1, the pressure gauge P2, the thermometer T2, and the thermometer T3. A diagram for explaining parameters used in a process is illustrated in FIG. 11, in which drying ratios are estimated.

The parameter definitions for explaining coolant states are represented, also including the above defined ones, as follows.

(Parameter definitions for explaining coolant states)

Pd: Radiation pressure. Measured by pressure gauge P2.

Td: Coolant temperature at exit of radiator 3. Measured by thermometer T3.

Tf: Coolant temperature at entrance of flow control valve 4. Measured by thermometer T2.

Pe: Coolant pressure at exit of flow control valve 4. Measured by pressure gauge P1.

Te: Evaporation temperature. Obtained from Pe and saturation vapor pressure of coolant.

hd: Coolant enthalpy at exit of radiator 3.

hf: Coolant enthalpy at entrance of flow control valve 4.

heL: Coolant saturated liquid enthalpy at pressure Pe.

heG: Coolant saturated vapor enthalpy at pressure Pe.

Xd: Drying rate when coolant at exit of radiator 3 is decompressed up to Pe.

Xe: Coolant drying rate at exit of flow control valve 4.

X: Drying ratio. X=Xe/Xd.

The calculation estimating the drying ratio is performed by the following procedure.

(Calculation Procedure for Estimating the Drying Ratio)

(1) hd (coolant enthalpy at the exit of the radiator 3) is calculated using Pd and Td.

(2) hf (coolant enthalpy at the entrance of the flow control valve 4) is calculated using Pd and Tf.

(3) heL (saturated liquid enthalpy) and heG (saturated vapor enthalpy) are obtained from Pe and the saturation vapor pressure of the coolant.

(4) Because the coolant enthalpy does not vary, even if the adiabatic expansion of the coolant is performed and the coolant is decompressed, Xd (drying rate when the coolant at the exit of the radiator 3 is decompressed up to Pe), Xe (coolant drying rate at the exit of the flow control valve 4), and the drying ratio X are calculated as follows.

Here, in the drying rate calculation, when the value becomes negative the value is set to zero, meanwhile when the value becomes not smaller than "1" the value is set to "1".

$$Xd=(hd-heL)/heG-heL) \quad \text{(Eq. 5)}$$

$$Xe=(hf-heL)/(heG-heL) \quad \text{(Eq. 6)}$$

$$X=(hf-heL)/(d-heL) \quad \text{(Eq. 7)}$$

The drying-ratio control-range determination unit 16B has drying-ratio data in which the COP becomes the maximum at respective points obtained when the radiation pressure Pd and the evaporation temperature Te are varied with a predetermined interval width in the range of Pd and Te conditions in which the air conditioner may operates (hereinafter referred to as the most suitable operational drying ratio data). For example, assuming that Pd is 9-11 MPa and the interval width is 1 MPa, and Te is 0-15 degrees and the interval width is 5 degrees, when the COP represented in FIG. 5 becomes the maximum value, the drying ratio data represents to the most suitable operational drying ratio data. The control range of the drying ratio is determined as follows using the most suitable operational drying ratio data.

(1) In response to the values of Pd and Te in the current operational state, the drying ratio when the COP becomes the maximum is obtained by interpolating the most suitable operational drying ratio data (hereinafter referred to as the most suitable drying ratio Xmax).

(2) A predetermined range such as the difference from the most suitable drying ratio Xmax being within 0.1 is determined to be the control range.

The predetermined range width is determined to be a width in which the COP little changes in response to the variation of the drying ratio.

For example, in an operational state in which Pd is 10 MPa, and Te is 10 degrees, Xmax is 0.29; then, the control range of the drying ratio falls to 0.19-0.39. As found in FIG. 5(*b*), if the drying ratio is in this control range, the COP varies less than 0.02 from the maximum value. The coolant flow controller 16C checks whether the drying ratio estimated by the drying-ratio estimation unit 16A is within the control range obtained by the drying-ratio control-range determination unit 16B, and if the drying ratio is not within the control range, the coolant flow controller 16C controls either or both of the operational frequency of the second compressor 10 and the flow command of the second flow control valve 12, so as to be in the control range. When the control is performed, suitable PID control is assumed to be performed. When the estimated drying ratio is larger, by increasing the cooling amount in the coolant cooler 15, the drying ratio is decreased, meanwhile when the estimated drying ratio is less, by decreasing the cooling amount in the coolant cooler 15, the drying ratio is increased. Here, if the operational frequency of the second compressor 10 is increased, the cooling amount increases, and if the flow command of the second flow control valve 12 is increased, the cooling amount increases.

In the configuration of this Embodiment 5, it is also effective that, by suitably controlling the heat-exchanging amount in the coolant cooling means using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a closed loop outside a room; thereby, leakage of the second coolant inside the room can be prevented.

Furthermore, a drying-ratio prediction means is provided to estimate the drying ratio, and the heat-exchanging amount is controlled in the coolant cooling means so that the drying ratio falls to a value where the COP is within a range dose to the maximum value; therefore, it is effective that the COP can surely be improved.

Although, in this Embodiment 5, the pressure gauge P1 as the first pressure measuring means is provided at the exit of the flow control valve 4, the pressure gauge P1 may be provided at any position between the exit of the flow control valve 4 and the entrance of the evaporator 5. However, in a case in which an apparatus, such as a compressor or another flow control valve, for varying the coolant pressure is provided at a position between the exit of the flow control valve 4 and the entrance of the evaporator 5, the pressure gauge is to be provided between the exit of the flow control valve 4 and the entrance of the apparatus. The pressure gauge P2 as the second pressure measuring means may be provided at any position between the exit of the compressor and the entrance of the flow control valve 4. Here, in a case in which two or more than two compressors are provided, the most high-pressure-side compressor is selected as the target.

Although, in the drying-ratio estimation unit 16A, the pressure Pe at the exit of the flow control valve 4 is measured by the pressure gauge P1 and is used, the temperature Te at the exit of the flow control valve 4 may be measured and used. The reason is because the coolant at the exit of the flow control valve 4 is in a gas-liquid two-phase state, and if either the temperature or the pressure is determined, the other one is also determined. Moreover, although the control range is obtained in the drying-ratio control-range determination unit 16B considering Pd and Te, the control range may be obtained considering not Te but Pe.

Although, in the drying-ratio control-range determination unit 16B, the most suitable operational drying ratio data that is drying ratio data when the COP takes the maximum value by combining Pd with Te is used, data in which the difference from the maximum value of the COP is within a predetermined range may be used.

Although the most suitable operational drying ratio data is obtained by interpolating to Pd and Te, the value at the nearest point may be used without interpolation.

Although the range width is fixed for obtaining the control range from the most suitable drying ratio, the width of the control range may be variable, for example, the difference from the COP is set to be within a predetermined value. Moreover, in the control range, the most suitable drying ratio is not necessary to be included, for example, a predetermined range that is larger than the most suitable drying ratio may be used. Although the most suitable operational drying ratio data is prepared in which both Pd and Te are varied, either Pd or Te may be fixed. A different control range in response to a set of Pd and Te is not searched, but, by specifying only one of Pd and Te, if unspecified one is within an estimated varying range, the drying ratio control range may be searched so that, regarding the COP, the difference from the maximum value is lower than a predetermined value. Furthermore, if the value is within an estimated varying range in response to both Pd and Te, the drying ratio control range is previously searched so that, regarding the COP, the difference from the maximum value is lower than a predetermined value; then, the value may be outputted.

If the drying-ratio control-range determination unit 16B determines the drying ratio control range in which the difference from the maximum value of the COP falls to within the predetermined range, any unit may be used.

Although in the coolant flow controller 16C, the PID control has been performed so that as the drying ratio is kept within the control range, a controller may also be used in which the cooling amount is controlled by the coolant cooling means so that the drying ratio falls to a specified value. According to control errors, if the control is performed to keep at a specified value, the control is resultantly performed within a predetermined range close to the specified value. The specified value may be determined, considering the value of the control error, so that the drying ratio does not exceed the control range, even if the control error is included. The drying ratio need not necessary be specified in which the COP becomes the maximum value. When the drying ratio is controlled within the control range, the control may also be performed by other than the PID control.

Here, in this Embodiment 5, although a case in which the configuration is applied to that in Embodiment 1 has been explained, in a case in which the configuration is applied to any one of the configurations, or any one of configurations simultaneously having characteristics of those configurations, included in Embodiment 2 through Embodiment 4, an effect similar to that can also be obtained. Moreover, in a case in which the coolant cooling means does not use a vapor-compression refrigeration cycle, even if the cooling amount is controlled so that the drying ratio is estimated and falls to within the predetermined range, an effect similar to the above can also be obtained. Not drying ratio, but flow-control-valve entrance temperature as coolant temperature at the entrance of the flow control valve 4 may also be used as an indicator and controlled. These facts are also applied to the other embodiments.

Embodiment 6

Figure 12:
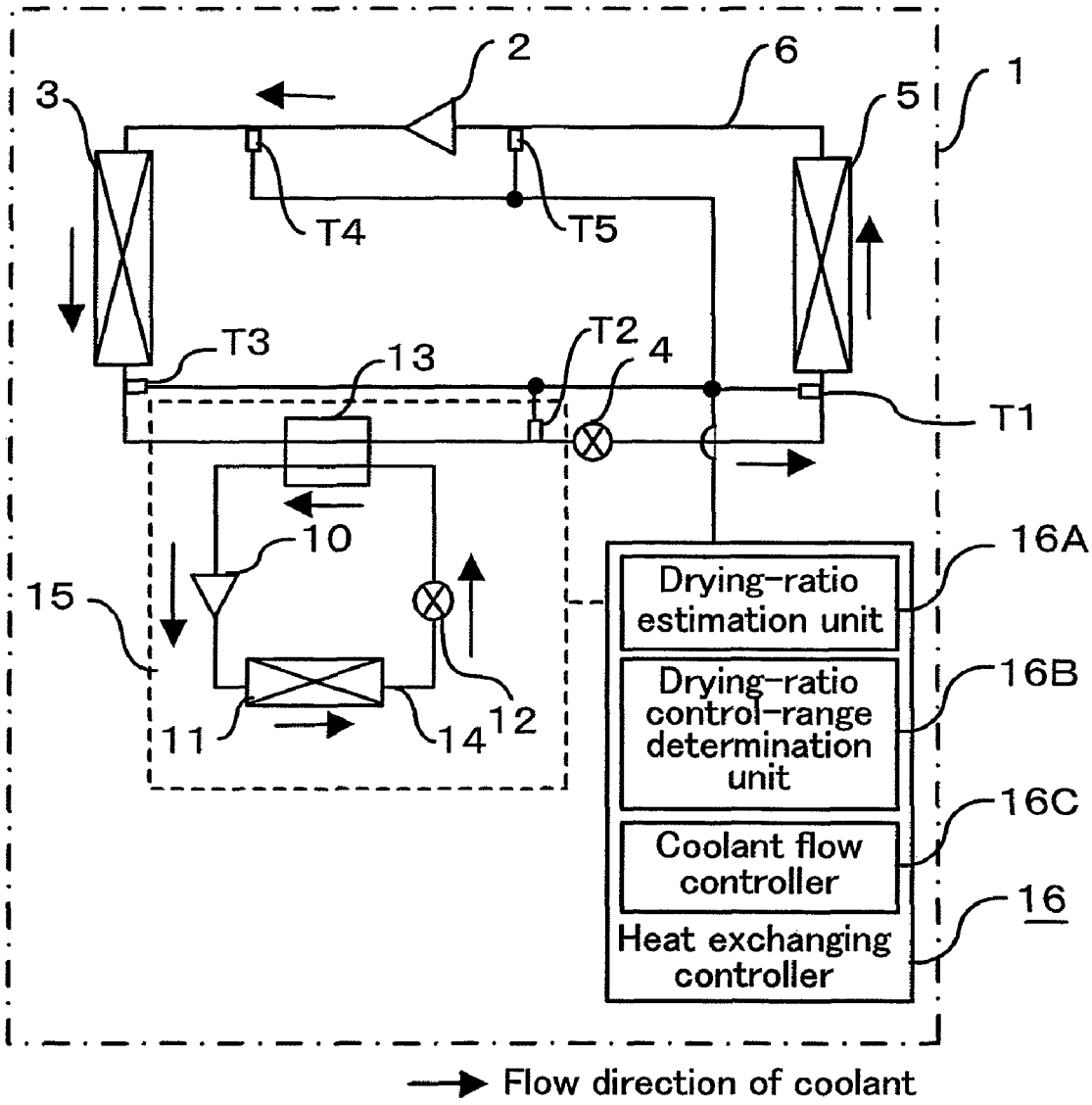
FIG. 12 is a coolant-circuit diagram explaining a configuration of an air conditioner according to Embodiment 6 of the present invention.

FIG. 12 is a coolant-circuit diagram illustrating a configuration of an air conditioner according to Embodiment 6. In Embodiment 6, Embodiment 5 is modified so that the pressure gauge for estimating the drying ratio is not used. Only different elements comparing with those in FIG. 10 according to Embodiment 5 are explained. Instead of the pressure gauges P1 and P2, the thermometer T1 as the first temperature measuring means provided at the exit of the flow control valve 4, a thermometer T4 as a fourth temperature measuring means provided at the exit of the radiator 3, and a thermometer T5 as a fifth temperature measuring means provided at the entrance of the radiator 3 are provided. Measurement values by the thermometers T1, T2, T3, T4, and T5 as predetermined sensors are inputted into the drying-ratio estimation unit 16A. The other configurations are the same as those in Embodiment 5.

The coolant flow is the same as that in Embodiment 5. The operation of the heat exchanging controller 16 is also similar to that in Embodiment 5. A procedure for estimating the drying ratio in the dying-ratio estimation unit 16A is differed from that in Embodiment 5. If the radiation pressure Pd and the evaporation pressure Pe can be estimated, the drying ratio can be estimated similarly to that in Embodiment 5; therefore, a method of estimating the radiation pressure Pd and the evaporation pressure Pe is explained. Therefore, the following parameters for representing the coolant state are additionally defined. Here, Te is directly measured by the thermometer T1.

(Definition of Parameters for Explaining Coolant State)

Tc: Coolant temperature at exit of radiator 3. Measured by thermometer T4.

Th: Coolant temperature at entrance of radiator 3. Measured by thermometer T5.

Tx: Overheat rate of coolant inhaled into compressor 3.

A method of estimating the radiation pressure Pd and the evaporation pressure Pe becomes as follows.

(Estimation Method for Radiation Pressure Pd and Evaporation Pressure Pe)

(1) Pe is obtained from Te and the saturation vapor pressure of the coolant.

(2) Overheat rate TX is obtained from Tc and Td.

(3) Pd is calculated using Pe and TX, the efficiency of the compressor, and Th.

In the configuration of this Embodiment 6, it is also effective that, by suitably controlling the heat-exchanging amount in the coolant cooling means, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a dosed loop outside a room; thereby, leakage of the second coolant inside the room can be prevented. The control is performed with providing the drying-ratio estimation means and estimating the drying ratio; thereby, it is effective that the COP can surely be improved.

Furthermore, it is effective that only a low-cost temperature sensor (thermometer) is used for the drying-ratio estimation means. However, because the pressure is not actually measured, the accuracy may deteriorate from that in Embodiment 5. Here, although the pressure between the flow control valve 4 and the compressor 3 has been assumed to be constant, because a pressure loss occurs in the heat exchanger, etc., points where pressure is measured are specifically needed to be increased. Considering the balance between the accuracy and the cost, the kind and the number of the sensors are determined. These are also applied to the other embodiments.

Here, in this Embodiment 6, although a case in which the configuration is applied to that in Embodiment 1 has been explained, in a case in which the configuration is applied to any one of the configurations, or any one of configurations simultaneously having characteristics of those configurations, included in Embodiment 2 through Embodiment 4, an effect similar to that can also be obtained.

Embodiment 7

Figure 13:
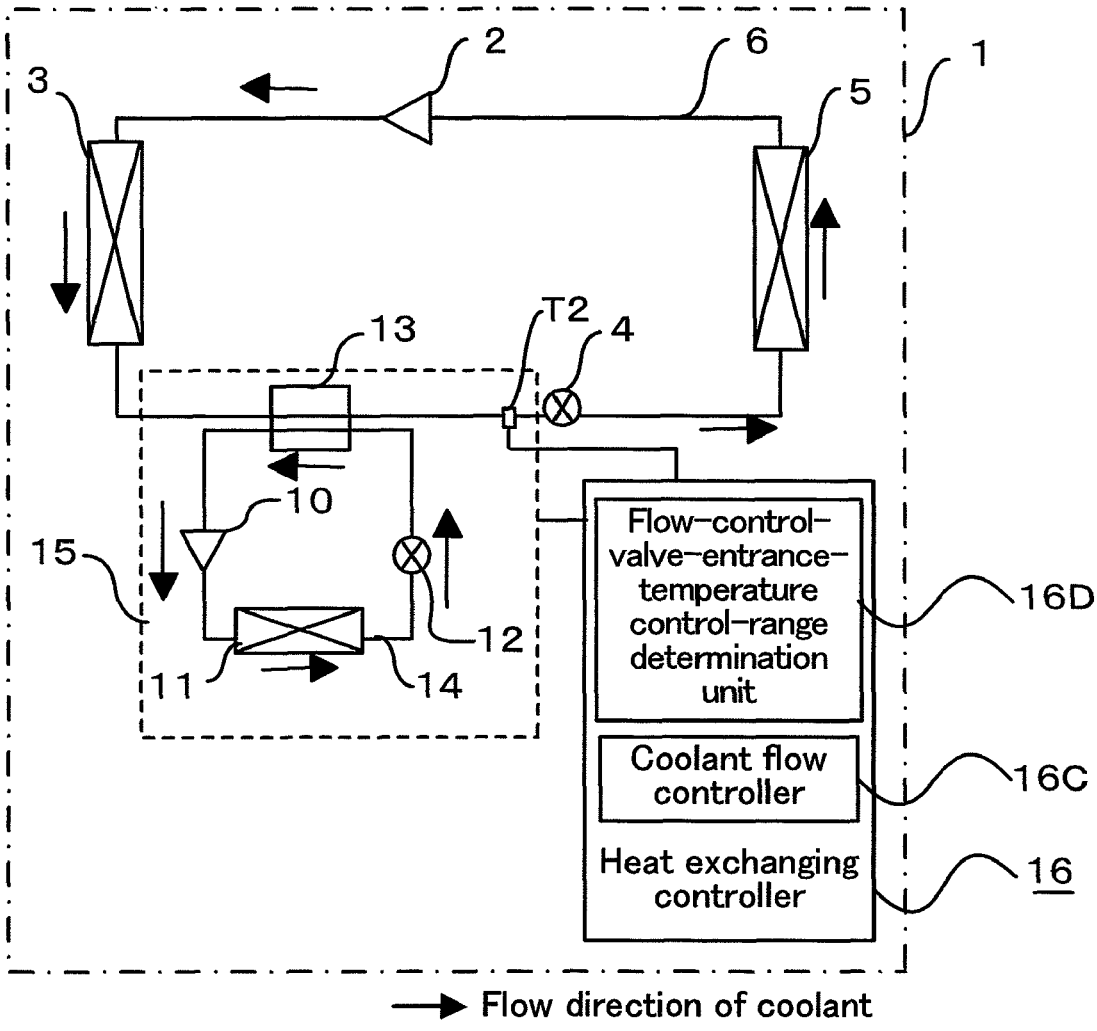
FIG. 13 is a coolant-circuit diagram explaining a configuration of an air conditioner according to Embodiment 7 of the present invention.

FIG. 13 is a coolant-circuit diagram illustrating a configuration of an air conditioner according to Embodiment 7. In Embodiment 7, Embodiment 1 is modified so that the control is performed not by the drying ratio but by the flow-control-valve entrance temperature having been measured. Only different elements comparing with those in FIG. 1 according to Embodiment 1 are explained.

In FIG. 13, the thermometer T2 is additionally provided as the second temperature measuring means provided at the entrance of the flow control valve 4. Moreover, the heat exchanging controller 16 is configured of a flow-control-valve-entrance-temperature control-range determination unit 16D as a flow-control-valve-entrance-temperature control-range determination means for obtaining a temperature range, in which the difference from the maximum value of the COP among values, when temperature at the entrance of the flow control valve is varied, falls to within a predetermined range, at the entrance of the flow control valve, and the coolant flow controller 16C as the control means for controlling the coolant flow so that the temperature at the entrance of the flow control valve falls to within the control range obtained by the flow-control-valve-entrance-temperature control-range determination unit 16D. The coolant flow controller 16C can control the command value in response to the operational frequency of the second compressor 10 and to the second flow control valve 12.

The other configurations are the same as those in Embodiment 1.

Next, an operation is explained. Coolant flow is the same as that in Embodiment 1. Hereinafter, an operation of the heat exchanger 16 is explained. Here, temperature at the entrance of the flow control valve is measured using the thermometer T2, and represented by the parameter Tf.

The flow-control-valve-entrance-temperature control-range determination unit 16D outputs a previously obtained control range of the temperature at the entrance of the flow control valve. Here, the previously obtained control range of the temperature at the entrance of the flow control valve means a range of the temperature at the entrance of the flow control valve (hereinafter referred to as the most suitable range), when the difference from the maximum value of the COP at the predetermined values of Pd and Te falls to within a predetermined range, assuming that the radiation pressure Pd and the evaporation temperature Te operate at a predetermined design value. For example, when Pd is 10 MPa, and Te is 10 degrees, providing that the COP ratio in FIG. 4(*b*) is within a range of not larger than 0.05 from the maximum value, the most suitable range falls to a range in which Tf is between 15 and 27 degrees.

In the coolant flow controller 16C, the temperature at the entrance of the flow control valve measured by the thermometer T2 is checked whether the temperature is within the most suitable range obtained by the flow-control-valve-entrance-temperature control-range determination unit 16D, that is, whether the temperature is within the control range, and, if the temperature is not within the control range, either or both the operational frequency of the second compressor 10 and the command value of the flowing amount into the second flow control valve 12 are controlled so as to fall to within the control range. In the controlling, suitable PID control is used in this case. When the estimated measured-temperature at the entrance of the flow control valve is higher, the temperature at the entrance of the flow control valve is decreased by the cooling amount in the coolant cooler 15 being increased; meanwhile, when the estimated temperature at the entrance of the flow control valve is lower, the temperature at the entrance of the flow control valve is increased by the cooling amount in the coolant cooler 15 being decreased.

In the configuration of this Embodiment 7, it is also effective that, by suitably controlling the heat-exchanging amount in the coolant cooling means, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a closed loop outside a room; thereby, leakage of the second coolant inside the room can be prevented.

Furthermore, the temperature at the entrance of the flow control valve is measured, and the heat-exchanging amount is controlled by the coolant cooling means so that the temperature measured falls to the temperature, where the COP falls to within the range dose to the maximum value, at the entrance of the flow control valve; thereby, it is effective that the COP can surely be improved.

The explanation related to the drying-ratio control-range determination unit 16B is also applied to that related to the flow-control-valve-entrance-temperature control-range determination unit 16D by changing the drying ratio to the temperature at the entrance of the flow control valve. The explanation related to the coolant flow controller 16C is also similar. This is also applied to the other embodiments in which the control is performed using the temperature at the entrance of the flow control valve.

Here, in this Embodiment 7, although a case in which the configuration is applied to that in Embodiment 1 has been explained, in a case in which the configuration is applied to any one of the configurations, or any one of configurations simultaneously having characteristics of those configurations, included in Embodiment 2 through Embodiment 4, an effect similar to that can also be obtained.

Embodiment 8

Figure 14:
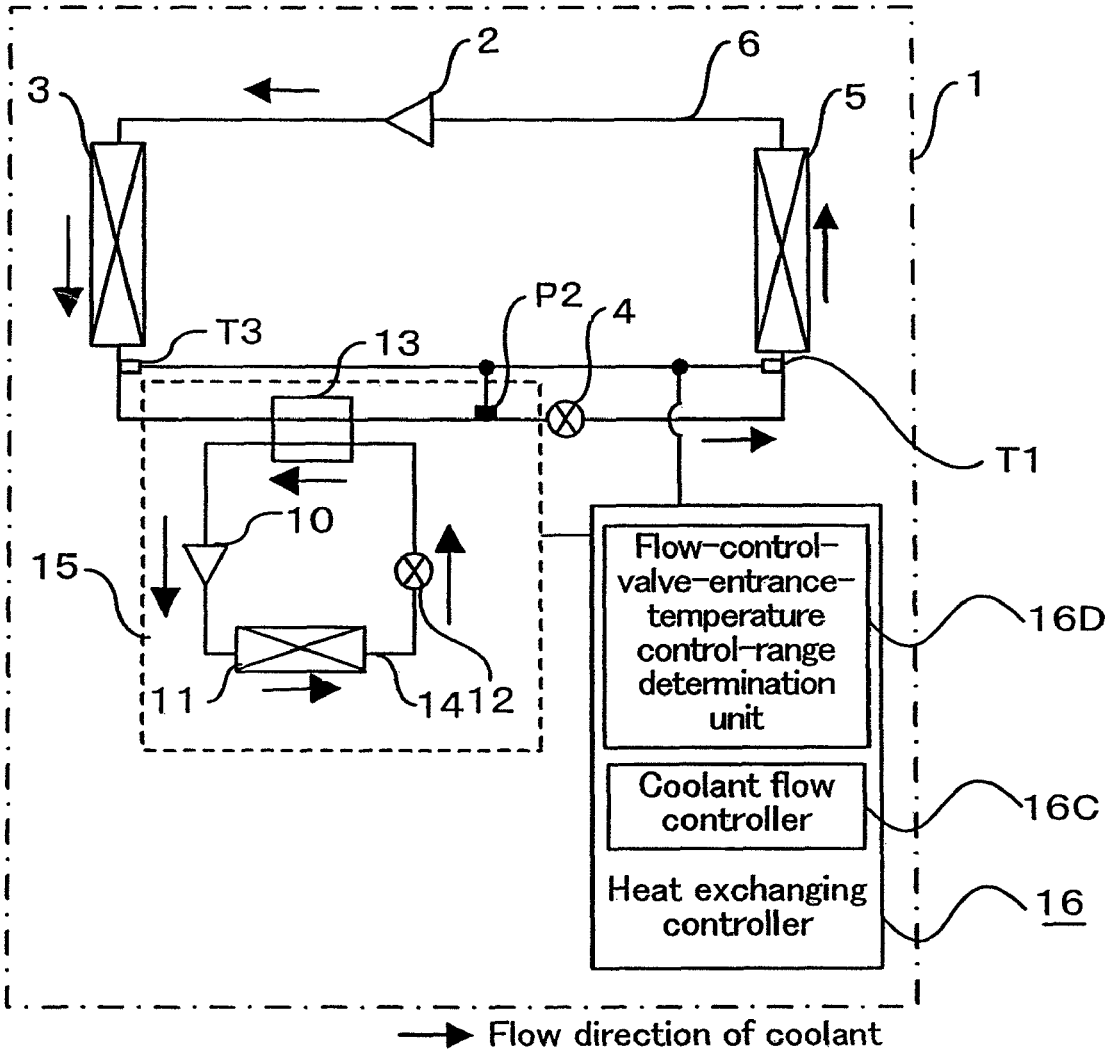
FIG. 14 is a coolant-circuit diagram explaining a configuration of an air conditioner according to Embodiment 8 of the present invention.

FIG. 14 is a coolant-circuit diagram illustrating a configuration of an air conditioner according to Embodiment 8. In Embodiment 8, Embodiment 7 is modified in such a way that the heat-exchanging amount is controlled in the coolant cooler 15 so that, by measuring the coolant temperature at the entrance of the coolant cooler 15, the coolant temperature at the exit of the coolant cooler 15, that is, at the entrance of the flow control valve 4 (temperature at the entrance of the flow control valve), is controlled, in which the COP becomes the maximum value. Only different elements comparing with those in FIG. 13 according to Embodiment 7 are explained.

In FIG. 14, instead of the thermometer T2, the thermometer T3 is provided as the third temperature measuring means provided at the exit of the radiator 3. The pressure gauge P2 as the second pressure measuring means provided between the exit of the second heat exchanger 13 and the entrance of the flow control valve 4, and the thermometer T1 as the first temperature measuring means provided at the exit of the flow control valve 4 are additionally provided. The flow-control-valve-entrance-temperature control-range determination unit 16D is also to be a flow-control-valve-entrance-temperature estimation means.

The other configurations are the same as those in Embodiment 7.

Next, an operation is explained. Coolant flow is the same as that in Embodiment 1. Hereinafter, an operation of the heat exchanger 16 is explained. The flow-control-valve-entrance-temperature control-range determination unit 16D has temperature data at the entrance of the flow control valve when the COP becomes the maximum value among the values of points that generate when the radiation pressure Pd and the evaporation temperature Te are varied with a predetermined interval width in the range of Pd and Te conditions in which the air conditioner may operates hereinafter referred to as the most suitable operational flow-control-valve-entrance-temperature data). For example, assuming that Pd is 9-11 MPa, whose interval width is 1 MPa, and Th is 0-15 degrees, whose interval width is 5 degrees, when the COP represented in FIG. 5 becomes the maximum value, the temperature data at the entrance of the flow-control-valve represents the most suitable operational flow-control-valve-entrance-temperature data.

In this Embodiment 8, the reference value of temperature at the entrance of the flow control valve is determined as follows from the most suitable operational flow-control-valve-entrance-temperature data. The most suitable operational flow-control-valve-entrance-temperature data is obtained that positions at the nearest point in response to the values of Pd and Te in the present operational state. If Pd is 10.2 MPa and Te is 8.5 degrees, the most suitable operational flow-control-valve-entrance-temperature data when Pd is 10 MPa, and Te is 10 degrees is obtained. Hereinafter, the obtained flow-control-valve entrance temperature is referred to as reference flow-control-valve entrance temperature Tfm. Here, when a plurality of the nearest ones is included, one of them is selected based on any rule, for example, the one having the highest flow-control-valve entrance temperature is selected.

The coolant flow controller 16C determines the flow volume of the second coolant as follows, and controls the operational frequency of the second compressor 10 so as to keep the flow volume. Due to a control error, etc., the operational state in which the COP becomes the maximum is not necessarily realized; however, it can be ensured that the operation can be performed in a state in which the COP is close to the maximum.

(1) A heat-exchanging amount in the coolant cooler 15 is determined from Td and Tfm.

(2) The flow volume of the second coolant is determined from the heat-exchanging amount considering various conditions such as the efficiency of the second heat exchanger 13, and temperature of the second coolant inhaled into the second heat exchanger 13.

(3) Considering the characteristics of the second compressor 10, and the state of the second flow control valve 12, etc., an operational frequency of the second compressor 10 is determined so as to keep the flow volume calculated in (2), and the control is performed so that the second compressor 10 is set to the operational frequency.

In the configuration of this Embodiment 8, it is also effective that, by suitably controlling the heat-exchanging amount in the coolant cooling means, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a closed loop outside a room; thereby, leakage of the second coolant inside the room can be prevented.

Furthermore, the temperature of the coolant inhaled into the coolant cooling means Td, the radiation pressure Pd, and the evaporation temperature Te are measured, the reference flow-control-valve entrance temperature is obtained in which the COP becomes the maximum value at the measured condition, and the heat-exchanging amount is controlled by the coolant cooling means so that the temperature falls to the reference flow-control-valve entrance temperature, that is, the flow volume of the second coolant is controlled; thereby, it is effective that the COP can surely be set dose to the maximum value.

A flow-control-valve-entrance-temperature estimating means is provided in addition to the flow-control-valve-entrance-temperature control-range determination unit 16D; thereby, the flow-control-valve-entrance-temperature control-range determination unit 16D may be configured in such a way that the PID control, etc. is performed in response to a result estimated by the flow-control-valve-entrance-temperature estimating means. Another control system other than the PID control may be also applied to the above.

Here, in this Embodiment 8, although a case in which the configuration is applied to that in Embodiment 1 has been explained, in a case in which the configuration is applied to any one of the configurations, or any one of configurations simultaneously having characteristics of those configurations, included in Embodiment 2 through Embodiment 4, an effect similar to that can also be obtained.

Embodiment 9

Figure 15:
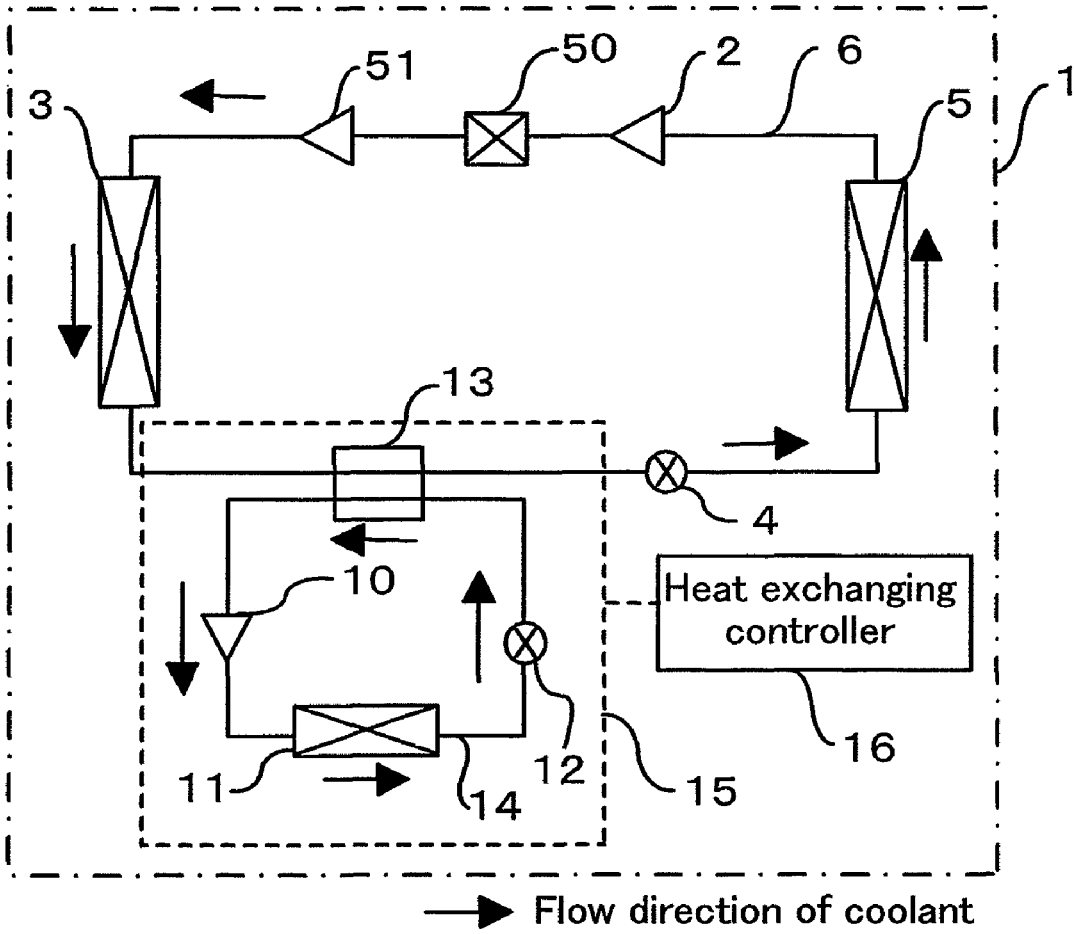
FIG. 15 is a coolant-circuit diagram explaining a configuration of an air conditioner according to Embodiment 9 of the present invention.

In FIG. 15, a coolant-circuit diagram is illustrated for explaining a configuration of a cooling only air conditioner according to Embodiment 9 of the present invention. In Embodiment 9, Embodiment 1 is modified by installing double compressors, so that a radiator for radiating coolant heat between the compressors is additionally provided. Only different elements from those in Embodiment 1 are explained. A third radiator 50 for radiating the heat from the coolant as compressed by the compressor 2, and a third compressor 51 for further compressing the coolant as outputted from the third radiator are additionally provided, so that the coolant outputted from the third compressor 51 is inputted into the radiator 3. The coolant is compressed, by the double compressors, to the same pressure as that in Embodiment 1.

The other configurations are the same as those in Embodiment 1.

Figure 16:
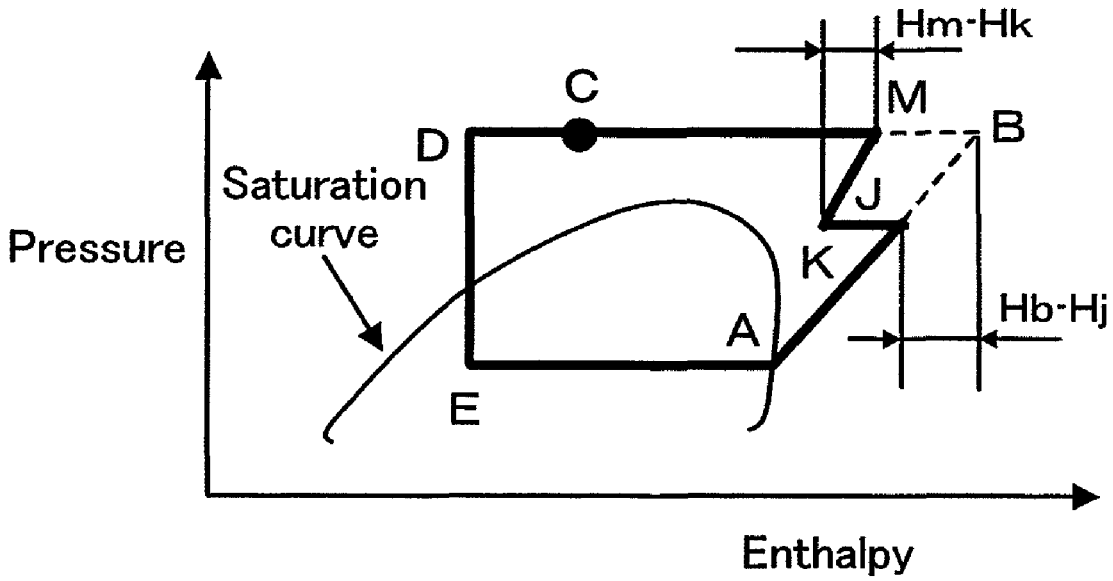
FIG. 16 is a pressure-enthalpy chart explaining the efficiency improvement by the configuration of the air conditioner according to Embodiment 9 of the present invention.

Next, an operation is explained. A pressure-enthalpy chart is illustrated in FIG. 16 for explaining the variation of coolant states in an air conditioner in Embodiment 9 according to the present invention. The solid lines represent the case in this Embodiment 9, meanwhile the broken lines represent the case in which the third radiator is not provided.

The coolant in the inlet side of the compressor 2 is in a low-temperature and low-pressure vapor state represented by the point "A" in FIG. 16. The coolant outputted from the compressor 2 is in a medium-pressure and medium-temperature vapor state represented by the point "J" positioned on the line A-B. The coolant, after heat is exchanged with air, etc., in the third radiator 50 becomes a state, represented by the point "K", being the same pressure as and a lower temperature than those represented by the point "J". The coolant is further compressed by the third compressor 51, so that the coolant changes into a high-pressure super-critical fluid state represented by the point "M". The coolant state at the point "M" is the same pressure as and a lower temperature than those at the point "B".

The locus of the coolant-state variation, after the coolant is inputted into the radiator 3, passes through the coolant cooler 15 and the flow control valve 4, and, until the coolant is inputted into the compressor 2, becomes the locus "M-C-D-E-A" that is the same as the locus in Embodiment 1.

In the configuration of this Embodiment 9, it is also effective that, by suitably controlling the heat-exchanging amount in the coolant cooling means, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a dosed loop outside a room; thereby, leakage of the second coolant inside the room can be prevented.

Furthermore, by providing the third radiator 50, it is effective that the COP can be more improved than that in a case in which the third radiator 50 is not provided. The reason is explained as follows. Here, the heat-exchanging amount in the evaporator 5 is the same whether the third radiator 50 is provided or not provided. Because the mechanical input when the third radiator 50 is provided becomes smaller, the COP is more improved. It is assumed that the enthalpies at the points "A", "B", "J", "K", and "M" are given by Ha, Hb, Hj, Hk, and Hm, respectively. Moreover, it is assumed that the mechanical input when the third radiator 50 is not provided is given by W1, meanwhile the mechanical input when the third radiator 50 is provided is given by W2. The difference between W1 and W2 is represented as follows.

$$W1 = Hb - Ha \quad \text{(Eq. 8)}$$

$$W2 = Hj - Ha + Hm - Hk \quad \text{(Eq. 9)}$$

$$W1 - W2 = Hb - Ha - (Hj - Ha + Hm - Hk) = (Hb - Hj) - (Hm - Hk) \quad \text{(Eq. 10)}$$

As explained above, even though the pressure values before and after compression are equivalent, the larger the enthalpy value, the more the mechanical input needed for compressing increases. In this case, because the enthalpy at the point "J" is larger than that at the point "K", the enthalpy difference along the line segment KM becomes greater than that along the line segment JB; thereby, Eq. 10 becomes necessarily positive.

Here, in this Embodiment 9, although a case in which the configuration is applied to that in Embodiment 1 has been explained, in a case in which the configuration is applied to any one of the configurations, or any one of configurations simultaneously having characteristics of those configurations, included in Embodiment 4 through Embodiment 8, an effect similar to that can also be obtained.

Embodiment 10

Figure 17:
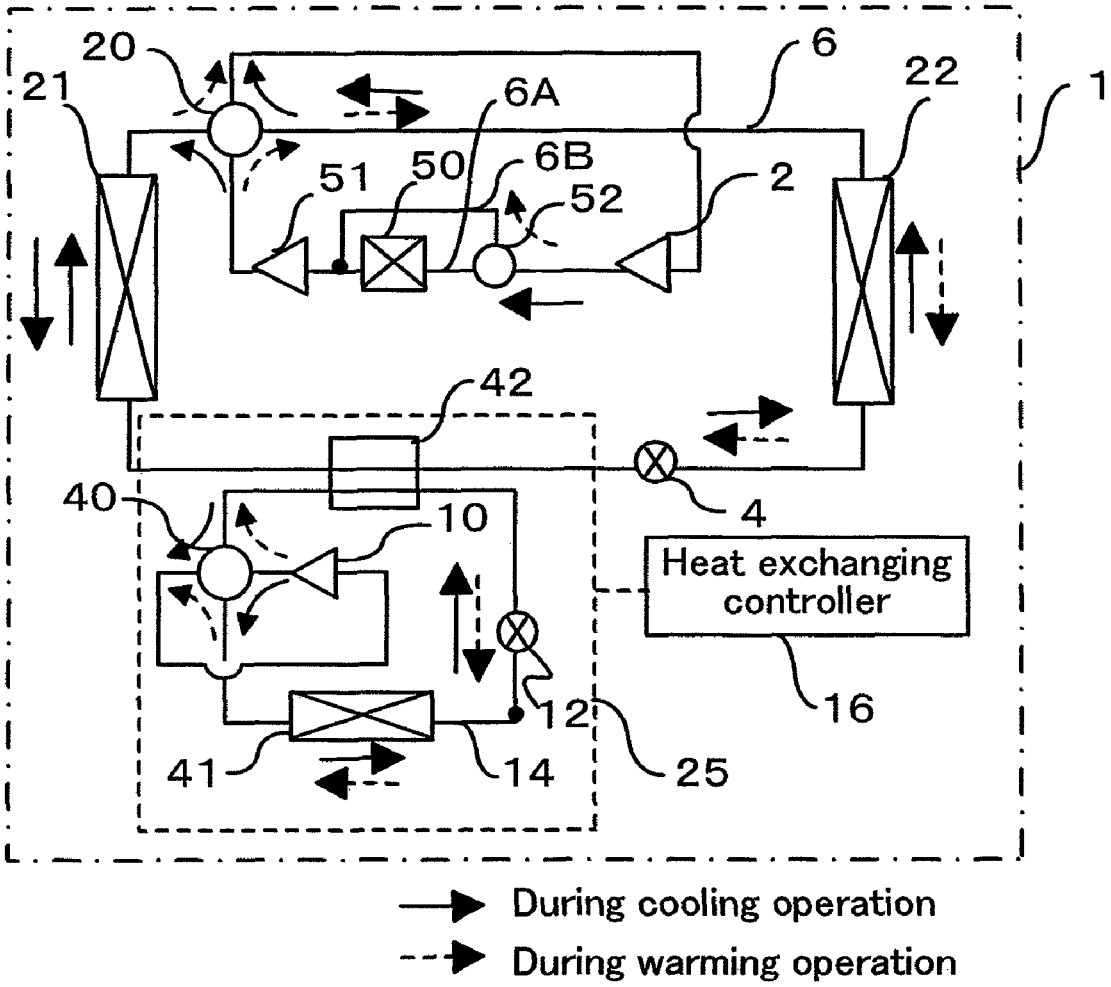
FIG. 17 is a coolant-circuit diagram explaining a configuration of an air conditioner according to Embodiment 10 of the present invention.

In FIG. 17, a coolant-circuit diagram is illustrated for explaining a configuration of an air conditioner having cooling and warming functions according to Embodiment 10 of the present invention. In Embodiment 10, Embodiment 3 is modified by installing double compressors, so that a radiator for radiating coolant heat is additionally provided between the compressors. Only different elements from those in FIG. 7 according to Embodiment 3 are explained.

The third radiator 50 for radiating heat from the coolant compressed by the compressor 2, the third compressor 51 for further compressing the coolant outputted from the third radiator 50, and a flow-route switching valve 52 as a flow-route changing means for directly inputting, during the warming operation, the coolant into the third compressor without circulating it into the third radiator 50 are additionally provided, so that the coolant outputted from the third compressor 51 is inputted into the four-way valve 20. Using the double compressors, the coolant is compressed up to the same pressure as that in Embodiment 3.

The flow-route switching valve 52 is provided between the compressor 2 and the third radiator 50. The flow-route switching valve 52 can circulate the coolant to either a coolant pipe 6A for inputting it into the third radiator 50 or a coolant pipe 6B connected to the coolant pipe 6 connecting the third radiator 50 with the third compressor 51. The other configurations are the same as those in Embodiment 3.

Next, an operation is explained. During the cooling operation, the flow-route switching valve 52 circulates the coolant to the coolant pipe 6A, that is, circulates it to the third radiator 50, so as to operate similarly to that in Embodiment 9.

During the warming operation, because the flow-route switching valve 52 flows the coolant through the coolant pipe 6B, and does not flow it into the third radiator 50, the air conditioner operates similarly to that in Embodiment 3. In Embodiment 3, the single compressor 2 compresses the coolant; accordingly, the difference is only that the compressor 2 and the third compressor 51 compress the coolant.

Even in the configuration of this Embodiment 10, it is effective that, by suitably controlling the heat-exchanging amount in the coolant cooling means, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. The coolant circuit of the second coolant can be configured by a dosed loop outside a room; thereby, leakage of the second coolant inside the room can be prevented.

Moreover, during the warming operation, it is effective that the COP can also be improved.

Furthermore, it is effective that, by providing the third radiator 50, the COP can be more improved than that in a case in which the third radiator 50 is not provided.

The flow-route switching valve 52 may be provided between the third radiator 50 and the third compressor 51. Moreover, the flow-route switching valves 52 may be provided on both sides of the third radiator 50. Any part may be applied as the flow-route switching valve 52, if it can circulate the coolant into the predetermined unit only during the cooling operation. These are also applied to the other embodiments having the flow-route switching valve 52.

Here, in this Embodiment 10, although a case in which the configuration, is applied to that in Embodiment 3 has been explained, in a case in which the configuration is applied to either Embodiment 2 or Embodiment 3 in which the characteristics of the configurations in Embodiment 2, and in Embodiment 4 through Embodiment 8 are additionally provided, an effect similar to that can also be obtained.

Embodiment 11

Figure 18:
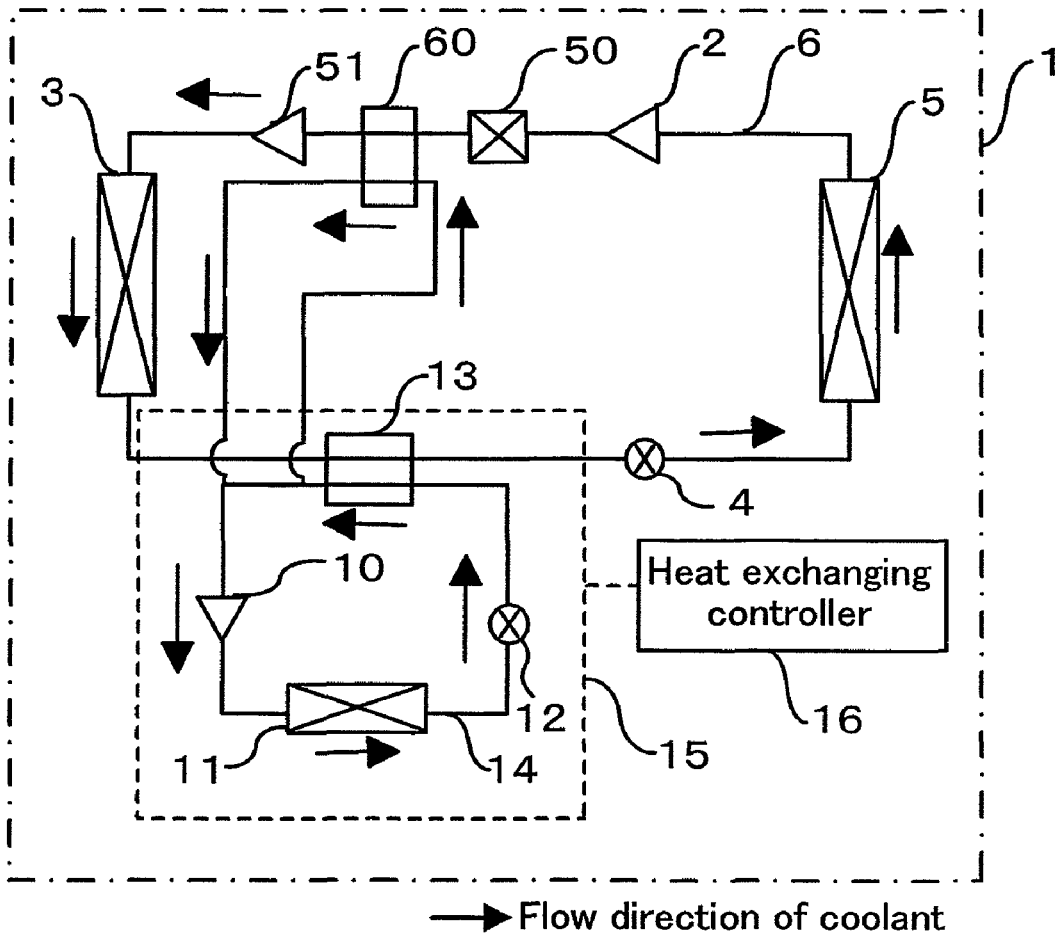
FIG. 18 is a coolant-circuit diagram explaining a configuration of an air conditioner according to Embodiment 11 of the present invention.

In FIG. 18, a coolant-circuit diagram is illustrated for explaining a configuration of a cooling only air conditioner according to Embodiment 11 of the present invention. In Embodiment 11, Embodiment 9 is modified so that a heat exchanger for cooling the coolant by the second coolant is additionally provided between the third radiator 50 and the third compressor 51. Only different elements from those in FIG. 16 according to Embodiment 9 are explained.

In FIG. 18, a third heat exchanger 60 is additionally provided for exchanging heat between the second coolant from the second heat exchanger 13 and the coolant from the third radiator 50. The coolant outputted from the third heat exchanger 60 is inputted into the third compressor 51, meanwhile the second coolant outputted from the third heat exchanger 60 is inputted into the second compressor.

The other configurations are the same as those in Embodiment 9.

Figure 19:
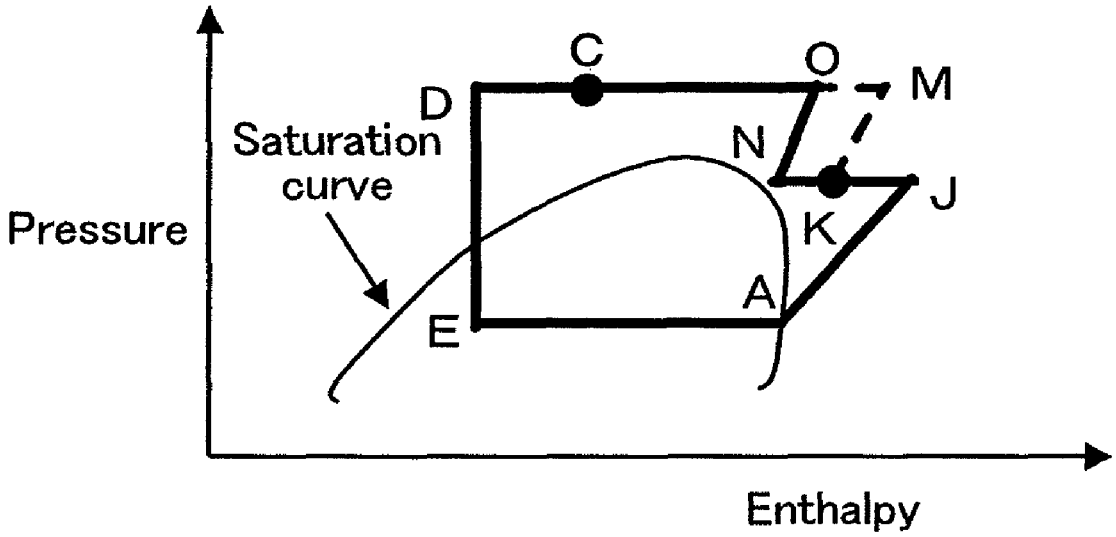
FIG. 19 is a pressure-enthalpy chart explaining the efficiency improvement by the configuration of the air conditioner according to Embodiment 11 of the present invention.

Next, an operation is explained. A pressure-enthalpy chart is illustrated in FIG. 19 for explaining the variation of coolant states of the air conditioner in Embodiment 11 according to the present invention. The solid lines represent the case in this Embodiment 11, meanwhile the broken lines represent the case in which the third heat exchanger 60 is not provided.

The locus of the coolant states, after the coolant is inhaled into the compressor and until outputted from the third heat exchanger 60, becomes the same locus "A-J-K" as that in Embodiment 9. The coolant is further cooled by the second coolant in the third heat exchanger 60; then, the coolant becomes the same pressure represented by the point "N" as that represented by the point "K", and further lower temperature state. The coolant is further compressed by the third compressor 51, and then, becomes a high-pressure supercritical fluid state represented by the point "0". In the coolant state at the point "0", the pressure is the same as that at the point "M", meanwhile its temperature is lower. The locus of the coolant-state variation, after the coolant is inputted into the radiator 3 and until inputted into the compressor 2, becomes the same locus "0-C-D-E-A" as that in Embodiment 1.

In the configuration of this Embodiment 11, it is also effective that, by suitably controlling the heat-exchanging amount in the coolant cooling means, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. The coolant circuit of the second coolant can be configured by a dosed loop outside a room, and leakage of the second coolant inside the room can be prevented. Moreover, by providing the third radiator 50, it is also effective that the COP can be more improved than that in a case in which the third radiator 50 is not provided.

Furthermore, by providing the third heat exchanger 60, it is also effective that the COP can be more improved than that in a case in which the third heat exchanger 60 is not provided. The reason that the COP is improved by providing the third heat exchanger 60 is because, similar to the case when the third radiator 50 is provided, mechanical input in the third compressor 51 is reduced when the enthalpy of the coolant inputted into the third compressor 51 is decreased.

Regarding the second coolant flowing in the third heat exchanger 60, the temperature is increased after the heat exchanged is performed by the coolant in the second heat exchanger 13; therefore, by the heat exchanged in the third heat exchanger 60, the mechanical input of the second-coolant cooling cycle is little increased. However, because the heat exchange amount in the second heat exchanger 13 is controlled so as to enable the COP to improve, the heat exchange amount in the third heat exchanger 60 cannot independently be determined.

Although the second coolant is flowed using the second heat exchanger 13 and the third heat exchanger 60 connected together in series, the second coolant may be flowed in parallel. By adding either or both of a compressor and a radiator, the coolant circuit of the second coolant flowing in the third heat exchanger 60 and the coolant circuit of the second coolant flowing in the second heat exchanger 13 may be separated. In such case, as the coolant flowing in the third heat exchanger 60, a coolant other than the second coolant may be used.

The third radiator 50 is not necessary to be provided. In a case in which the temperature of the coolant outputted from the compressor 2 is higher than that of the outdoor air, the COP when the third radiator 50 is provided can be more improved. The reason is because the heat exchange amount in the third radiator 50 decreases because only a portion that is not cooled by the outdoor air may be cooled by the third radiator 50, and as a result, the mechanical input in the second compressor 10 is reduced.

Here, in this Embodiment 11, although a case in which the configuration is applied to that in Embodiment 9 has been explained, in a case in which the configuration is applied to any one of the configurations or any one of configurations simultaneously having the characteristics of the configurations, included in Embodiment 1, Embodiment 2, and Embodiment 4 through Embodiment 8, an effect similar to that can also be obtained.

Embodiment 12

Figure 20:
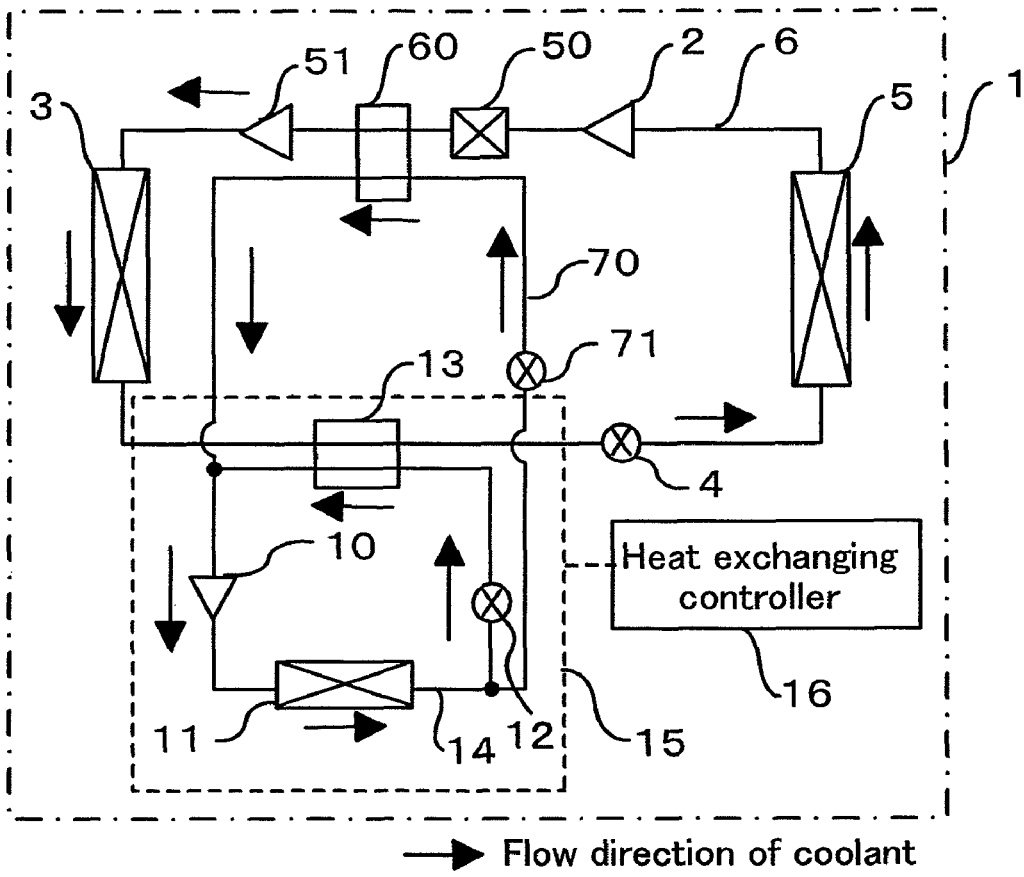
FIG. 20 is a coolant-circuit diagram explaining a configuration of an air conditioner according to Embodiment 12 of the present invention.

In FIG. 20, a coolant-circuit diagram is illustrated for explaining a configuration of a cooling only air conditioner according to Embodiment 12 of the present invention. In Embodiment 12, Embodiment 11 is modified so that the coolant is flowed in parallel in the third heat exchanger 60 and the second heat exchanger 13. Only different elements from those in FIG. 18 according to Embodiment 11 are explained. Here, Embodiment 12 is also configured based on Embodiment 9, and a different modification from Embodiment 11 is performed.

In FIG. 20, a second bypass pipe 70 for introducing the second coolant into the third heat exchanger 60, and a forth flow control valve 71 for regulating the flow volume of the second coolant flowing into the third heat exchanger 60 are additionally provided. Both of the forth flow control valve 71 and the second flow control valve 12 are arranged so as to flow in parallel the coolant outputted from the condenser 11. The second coolant flows through the forth flow control valve 71, the second bypass pipe 70, the third heat exchanger 60, and the second compressor 10, in that sequence.

The other configurations are the same as those in Embodiment 11.

Next, an operation is explained. The variation of coolant states of the air conditioner in Embodiment 12 according to the present invention becomes the same as that in FIG. 19 according to Embodiment 11.

Because the variation of the coolant states is the same as that in Embodiment 11, Embodiment 12 also has the effect as Embodiment 11. Moreover, because the forth flow control valve 71 is provided therein, the flow volume of the second coolant flowing in the third heat exchanger 60 can be independently controlled from the flow volume of the second coolant flowing in the second heat exchanger 13; therefore, it is effective that an operational condition when the COP becomes the maximum is easy to be realized.

Here, in this Embodiment 12, although a case in which the configuration is applied to that in Embodiment 9 has been explained, in a case in which the configuration is applied to any one of the configurations or any one of configurations simultaneously having the characteristics of the configurations, included in Embodiment 1 through Embodiment 8, and Embodiment 10, an effect similar to that can also be obtained.

Embodiment 13

Figure 21:
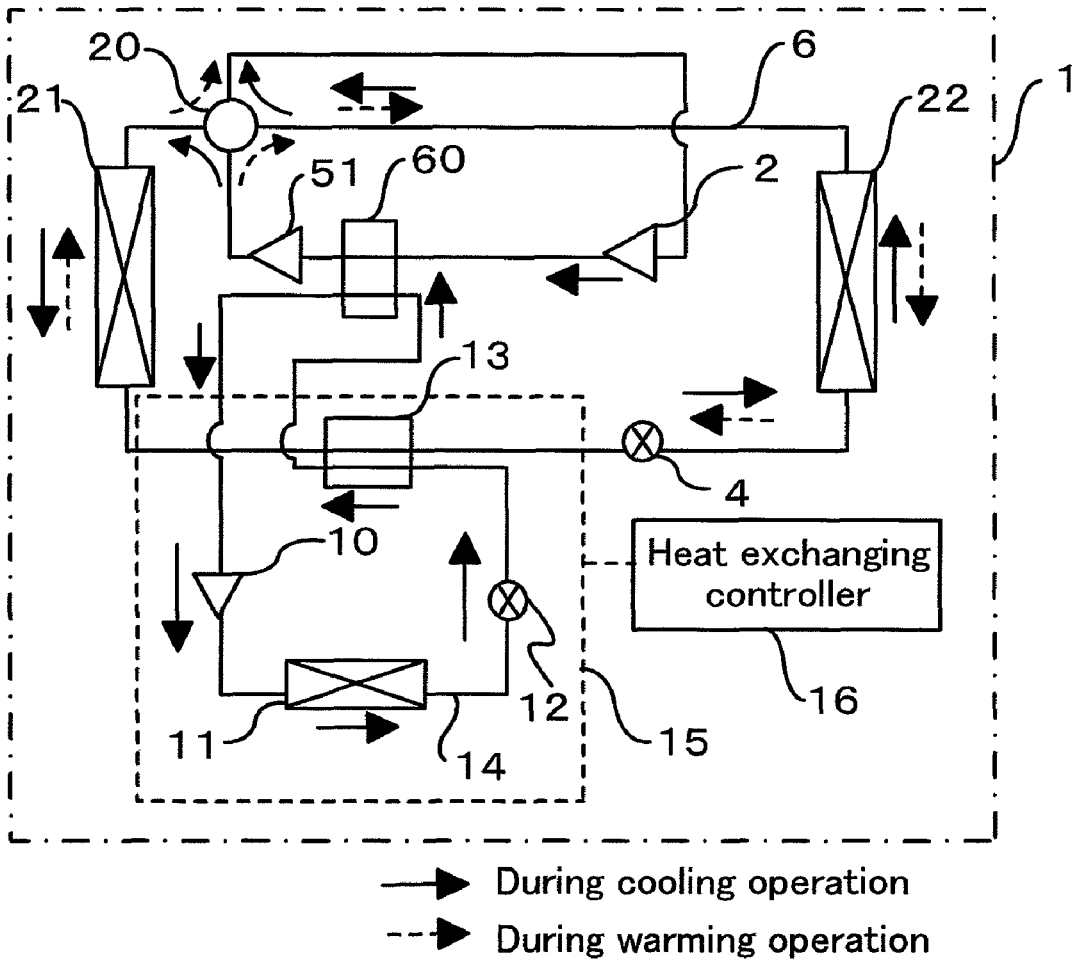
FIG. 21 is a coolant-circuit diagram explaining a configuration of an air conditioner according to Embodiment 13 of the present invention.

In FIG. 21, a coolant-circuit diagram is illustrated for explaining a configuration of an air conditioner having cooling and warming functions according to Embodiment 13 of the present invention. In Embodiment 13, Embodiment 2 is modified by installing double compressors, so that the third heat exchanger 60 is additionally provided between the compressors for exchanging heat between the coolant and the second coolant. Only different elements from those in FIG. 6 according to Embodiment 2 are explained.

In FIG. 21, a third heat exchanger 60 and a third compressor 51 are additionally installed between the compressor 2 and the four-way valve 20. The coolant outputted from the compressor 2 flows through the third heat exchanger 60 and the third compressor 51, and is inputted into the four-way valve 20, in that sequence.

The other configurations are the same as those in Embodiment 2.

Next, an operation is explained. During a cooling operation, the variation of coolant states in the air conditioner according to Embodiment 12 of the present invention approximately becomes the same as that in FIG. 16 according to Embodiment 9. However, the locus "J-K" as the variation of the coolant status is given not by the third radiator 50 but by the third heat exchanger 60.

During a warming operation, because the coolant cooler 15 is not operated similarly to that in Embodiment 2, the locus of the variation of the coolant states during the warming operation becomes the same locus as the locus "A-B-C-F-A" in FIG. 2 according to Embodiment 2.

In the configuration of this Embodiment 13, during the cooling operation, it is also effective that, by suitably controlling the heat-exchanging amount in the coolant cooling means, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. Moreover, the coolant circuit of the second coolant can be configured by a dosed loop outside a room; thereby, leakage of the second coolant inside the room can be prevented.

Furthermore, it is effective that, by providing the third heat exchanger 60, the COP can be more improved than that in a case in which the third heat exchanger 60 is not provided.

Embodiment 14

Figure 22:
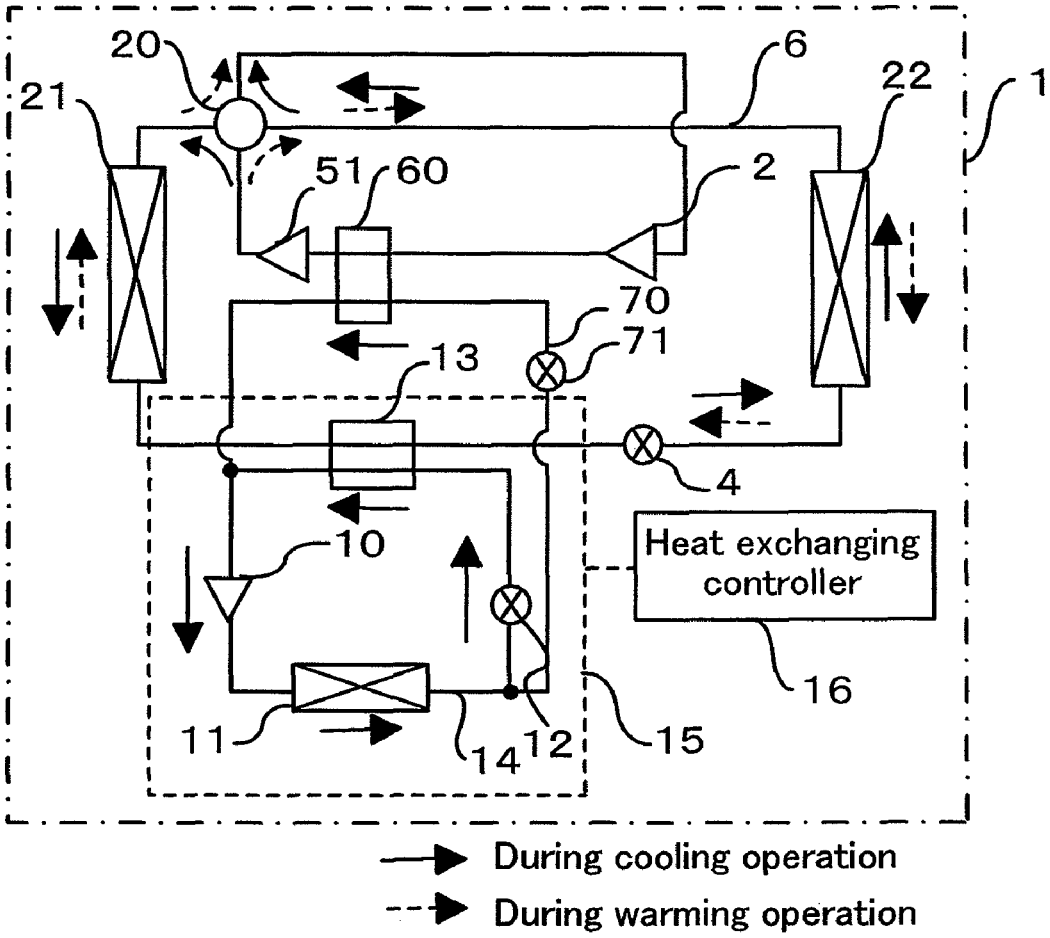
FIG. 22 is a coolant-circuit diagram explaining a configuration of an air conditioner according to Embodiment 14 of the present invention.

In FIG. 22, a coolant-circuit diagram is illustrated for explaining a configuration of an air conditioner having cooling and warming functions according to Embodiment 14 of the present invention. In Embodiment 14, Embodiment 13 is modified, so that the coolant is flowed in parallel in the third heat exchanger 60 and the second heat exchanger 13. Only different elements from those in FIG. 21 according to Embodiment 13 are explained.

In FIG. 22, the second bypass pipe 70 for introducing the second coolant into the third heat exchanger 60, and the forth flow control valve 71 for regulating the flow volume of the second coolant flowing in the third heat exchanger 60 are additionally provided. Both of the forth flow control valve 71 and the second flow control valve 12 are installed so as to flow in parallel the coolant outputted from the condenser 11. The second coolant flows through the forth flow control valve 71, the second bypass pipe 70, the third heat exchanger 60, and the second compressor 10, in that sequence.

The other configurations are the same as those in Embodiment 13.

Next, an operation is explained. During a cooling operation, the variation of coolant states in the air conditioner according to Embodiment 14 of the present invention, similarly to that in Embodiment 13, approximately becomes the same as that in FIG. 16 according to Embodiment 9. Although a point in which the variation of the coolant states in the locus "J-K" is given not by the third radiator 50 but by the third heat exchanger 60 is differed from that in FIG. 16, the point is the same as that in Embodiment 13.

Because the variation of the coolant states in Embodiment 14 is the same as that in Embodiment 13, the same effect as that in Embodiment 13 is also obtained in this Embodiment 14.

Moreover, because the forth flow control valve 71 is provided therein, the flow volume of the second coolant flowing in the third heat exchanger 60 can be independently controlled from the flow volume of the second coolant flowing in the second heat exchanger 13; therefore, it is effective that an operational condition when the COP becomes the maximum is easy to be realized.

Embodiment 15

Figure 23:
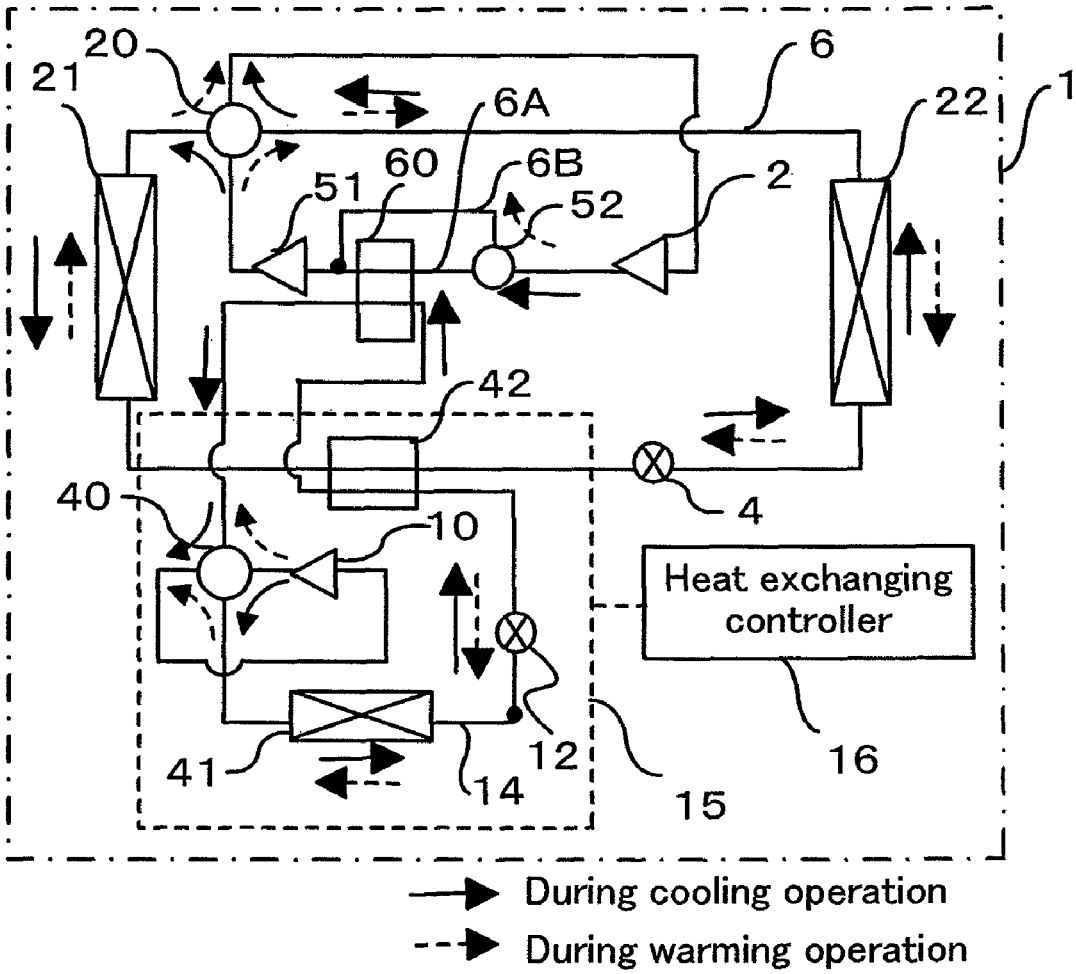
FIG. 23 is a coolant-circuit diagram explaining a configuration of an air conditioner according to Embodiment 15 of the present invention.

In FIG. 23, a coolant-circuit diagram is illustrated for explaining a configuration of an air conditioner having cooling and warming functions according to Embodiment 15 of the present invention. In Embodiment 15, Embodiment 3 is modified by installing double compressors, so that the third heat exchanger 60 is additionally provided between the compressors for exchanging heat between the coolant and the second coolant during a cooling operation. Only different elements from those in FIG. 7 according to Embodiment 3 are explained.

In FIG. 23, the third heat exchanger 60, the third compressor 51, and the floe-route switching valve 52 as a flow-route switching means for directly inputting the coolant, during a warming operation, into the third compressor 51 without flowing it into the third heat exchanger 60 are additionally provided between the compressor 2 and the four-way valve 20. The coolant outputted from the compressor 2 flows through the third heat exchanger 60 and the third compressor 51; then, the coolant is inputted into the four-way valve 20, in that sequence. Compression is performed, using the double compressors, up to the same pressure as that in Embodiment 3.

The flow-route switching valve 52 is provided between the compressor 2 and the third heat exchanger 60. By the flow-route switching valve 52, the coolant can be flowed in either the coolant pipe 6A introducing it to the third heat exchanger 60 or the coolant pipe 6B connected to the coolant pipe 6 that connects the third heat exchanger 60 with the third compressor 51.

The other configurations are the same as those in Embodiment 3.

Next, an operation is explained. During a cooling operation, the flow-route switching valve 52 flows the coolant through the coolant pipe 6A, that is, flows it into the third heat exchanger 60, which operates similar to that in Embodiment 13.

During a warming operation, because the flow-route switching valve 52 flows the coolant through the coolant pipe 6B, but does not flow it into the third heat exchanger 60, the air conditioner operates similar to that in Embodiment 3. The reason in which the coolant is not flowed into the third heat exchanger 60 during the warming operation is because the COP is not to be decreased. If the coolant is flowed in the third heat exchanger 60 during the warming operation, the enthalpy of the coolant inputted into the third compressor 51 increases; thereby, the mechanical input in the third compressor 51 is increased. Although a heat amount radiated by the indoor heat exchanger 22 is also increased, the increasing heat amount is approximately equivalent to the increase of the mechanical input in the third compressor 51; therefore, regarding only the increase, the COP is "1". Because the COP when the coolant does not flow in the third heat exchanger 60 is larger than "1", when the COP only due to the increase is "1", the COP decreases.

Here, in a case in which the high temperature is needed during the warming operation, and the overheat rate of the coolant inputted into the compressor 2 is needed to be at a predetermined value, if the overheat rate of the coolant inputted into the compressor 2 is set to nil, and calories corresponding to the overheat rate is heated with the coolant being flowed into the third heat exchanger 60 during the warming operation, the COP can be improved.

By determining whether the overheat rate of the coolant inputted into the compressor 2 during the warming operation is needed to be set at the predetermined value, only when the overheat rate is needed to be set at the predetermined value, during the warming operation, the coolant may be flowed into the third heat exchanger 60.

In the configuration of this Embodiment 15, during the cooling operation, it is also effective that, by suitably controlling the heat-exchanging amount in the coolant cooling means, using the heat-exchanging control means, the COP can surely be improved. It is also effective that, even if usage of the second coolant that is flammable or its global warming potential is inferior to that of the first coolant is decreased, the COP equivalent to that of a case in which only the second coolant is used can be realized. The coolant circuit of the second coolant can be configured by a closed loop outside a room; thereby, leakage of the second coolant inside the room can be prevented.

Moreover, it is also effective that the COP can be improved during the warming operation.

Furthermore, it is effective that, by providing the third heat exchanger 60, the COP can be more improved than that in a case in which the third heat exchanger 60 is not provided.

If the third radiator 50 is additionally provided, similarly to Embodiment 11, in a case in which the temperature of the coolant outputted from the compressor 2 is higher than that of the outdoor air, it is effective that the COP can be more improved than that in a case in which the third radiator 50 is not provided. When the third radiator 50 is also provided, the third radiator 50 is additionally provided between the third heat exchanger 60 and the flow-route switching valve 52 so that the coolant does not flow in the third radiator 50 during the warming operation.

Embodiment 16

Figure 24:
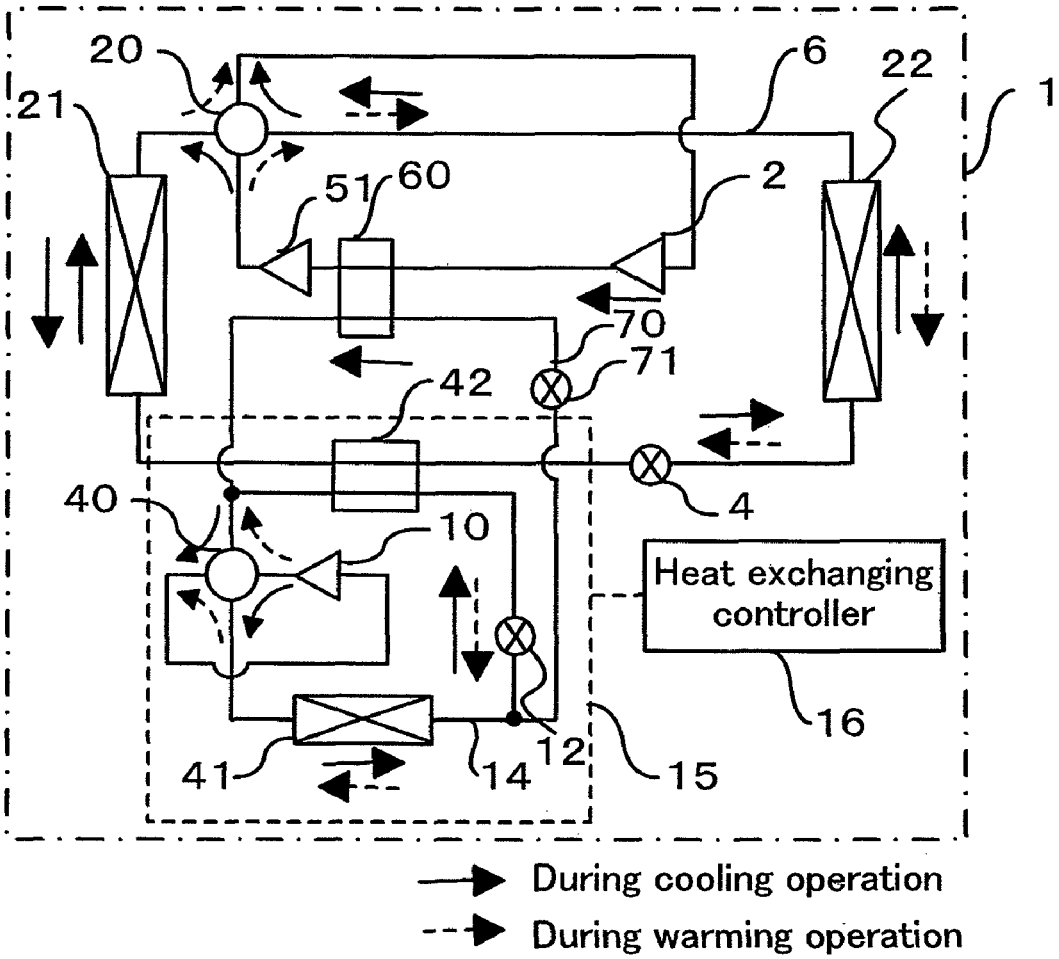
FIG. 24 is a coolant-circuit diagram explaining a configuration of an air conditioner according to Embodiment 16 of the present invention.

In FIG. 24, a coolant-circuit diagram is illustrated for explaining a configuration of an air conditioner having cooling and warming functions according to Embodiment 16 of the present invention. In Embodiment 16, Embodiment 15 is modified so that the coolant flows in parallel through the third heat exchanger 60 and the second heat exchanger 13. Only different elements from those in FIG. 23 according to Embodiment 15 are explained.

In FIG. 24, the second bypass pipe 70 for introducing the second coolant into the third heat exchanger 60, and the forth flow control valve 71 for regulating the flow volume of the second coolant flowing in the third heat exchanger 60 are additionally provided. Both of the forth flow control valve 71 and the second flow control valve 12 are arranged so as to flow in parallel the coolant outputted from the condenser 11. The second coolant flows through the forth flow control valve 71, the second bypass pipe 70, the third heat exchanger 60, and the second compressor 10, in that sequence.

The flow-route switching valve 52 for flowing, only during a cooling operation, the coolant into the third heat exchanger 60 is not provided.

The other configurations are the same as those in Embodiment 15.

Next, an operation is explained. During a cooling operation, the variation of the coolant state in an air conditioner according to Embodiment 16 of the present invention becomes, similarly to Embodiment 15, approximately the same as that in FIG. 16 according to Embodiment 9.

During a warming operation, the forth flow control valve 71 is controlled so as not to flow the second coolant into the third heat exchanger 60, and the second flow control valve 12 is controlled similarly to Embodiment 3. During the warming operation, the variation of the coolant state becomes, similarly to Embodiment 15, the same as that in FIG. 8 according to Embodiment 3.

This Embodiment 16 also has the same effect as that in Embodiment 15, because the variation of the coolant states is the same.

Moreover, because the forth flow control valve 71 is provided, the flow volume of the second coolant flowing in the third heat exchanger 60 can be independently controlled from the flow volume of the second coolant flowing in the second heat exchanger 13; therefore, it is effective that the operational condition in which the COP becomes the maximum is easy to be realized. Furthermore, during the warming operation, because the second coolant is not flowed in the third heat exchanger 60 using the forth flow control valve 71, the heat-exchanging amount can be set at nil; therefore, it is effective that the flow-route switching valve 52 that is needed in Embodiment 15 is not needed.

If the third radiator 50 is additionally provided, similarly to Embodiment 11, in a case in which the temperature of the coolant outputted from the compressor 2 is higher than that of the outdoor air, it is effective that the COP can be more improved than that in a case in which the third radiator 50 is not provided. In a case in which the third radiator 50 is additionally provided, the flow-route switching valve 52 operating so that the coolant does not flow in the third radiator 50 during the warming operation is also additionally provided.

Embodiment 17

Figure 25:
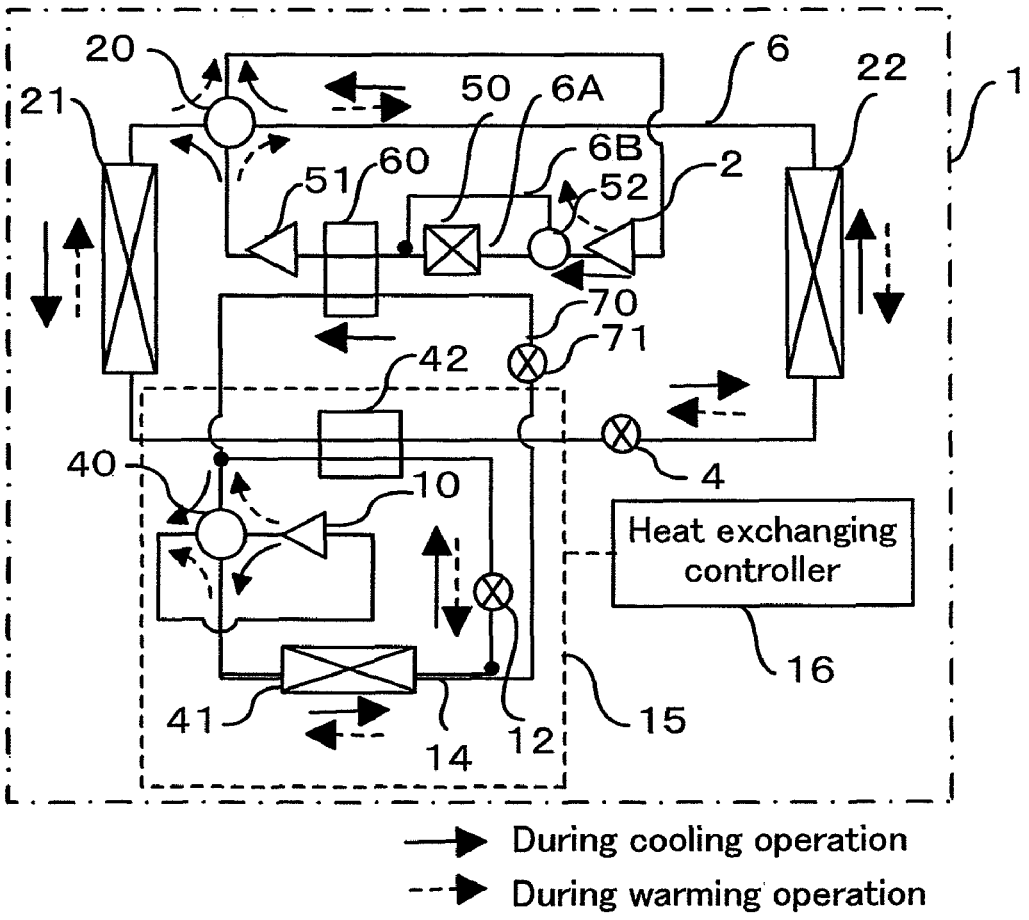
FIG. 25 is a coolant-circuit diagram explaining a configuration of an air conditioner according to Embodiment 17 of the present invention.

In FIG. 25, a coolant-circuit diagram is illustrated for explaining a configuration of an air conditioner having cooling and warming functions according to Embodiment 17 of the present invention. In Embodiment 17, Embodiment 16 is modified so that the third radiator 50 is provided. Only different elements from those in FIG. 24 according to Embodiment 16 are explained.

In FIG. 25, the third radiator 50, and the flow-route switching valve 52 as a flow-route switching means for inputting the coolant into the third heat exchanger 60 without flowing it in the third radiator 50 during a warming operation are additionally provided.

The flow-route switching valve 52 is installed between the compressor 2 and the third radiator 50. In the flow-route switching valve 52, the coolant can flow either through the coolant pipe 6A for introducing the coolant into the third radiator 50 or through the coolant pipe 6B connected to the coolant pipe 6 that connects the third radiator 50 with the third heat exchanger 60.

The other configurations are the same as those in Embodiment 16.

Next, an operation is explained. During a cooling operation, the variation of the coolant states in the air conditioner according to Embodiment 17 of the present invention becomes the same as that in FIG. 18 according to Embodiment 11.

During a warming operation, the forth flow control valve 71 is controlled so as not to flow the second coolant into the third heat exchanger 60, and the second flow control valve 12 is controlled similarly to Embodiment 3. The variation of the coolant states during the warming operation becomes, similarly to Embodiment 16, the same as that in FIG. 8 according to Embodiment 3.

In this Embodiment 17, in addition to the effect in Embodiment 16, it is effective that, by providing the third radiator 50, the COP can be more improved than that in a case in which the third radiator 50 is not provided.

Although, in this Embodiment 17, the coolant is flowed into the third heat exchanger 60 during the warming operation, even though it is configured such that the coolant is not flowed, the same effect is obtained.

What is claimed is:

1. A refrigerator comprising:

a first compressor for compressing carbon dioxide as a first coolant;

a first radiator for radiating heat from the first coolant;

a first flow control valve for regulating flow volume of the first coolant;

a first evaporator for evaporating the first coolant;

coolant cooling means for cooling the first coolant and including a second compressor for compressing a second coolant, the second coolant having an energy consumption efficiency higher than that of the first coolant, a condenser for radiating heat from the second coolant, a second flow control valve for regulating flow volume of the second coolant, and a second evaporator for evaporating, with heat from the first coolant, the second coolant;

heat-exchange-amount control means for controlling quantity of heat exchanged in the coolant cooling means so that a coefficient of performance (COP) value is obtained, in which the difference between the COP value and the maximum COP value obtained when the quantity of heat exchanged in the coolant cooling means is varied under predetermined operational conditions, is within a first predetermined range, wherein the first coolant is circulated through the first compressor, the first radiator, the coolant cooling means, the first flow control valve, and the first evaporator, in that sequence, the second coolant is circulated through the second compressor, the condenser, the second flow control valve, and the second evaporator, in that sequence, and the second coolant, in a second refrigeration cycle, has a cooling capacity in a range of from about one-tenth to about one-fifth of cooling capacity of the first coolant in a first refrigeration cycle.

2. The refrigerator as claimed in claim 1, further comprising:

first temperature-measuring means for measuring first flow-control-valve entrance temperature as temperature of the first coolant entering the first flow control valve, wherein the heat-exchange-amount control means includes:

flow-control-valve-entrance-temperature control-range determination means for determining control range of the first flow-control-valve entrance temperature, so that the COP value is obtained, in which the difference between the COP value and the maximum COP value obtained when the first flow-control-valve entrance temperature is varied under predetermined operational conditions is within a second predetermined range; and control means for controlling flow volume of the second coolant flowing in the coolant cooling means, so that the temperature of the first coolant measured by the second temperature-measuring means is within the control range.

3. The refrigerator as claimed in claim 1, further comprising:

first temperature-measuring means for measuring coolant temperature of the first coolant exiting the first radiator, wherein the heat-exchange-amount control means includes:

flow-control-valve-entrance-temperature estimation means for estimating, from the coolant temperature measured by the first temperature-measuring means and the quantity of heat exchanged in the coolant cooling means, temperature of the first coolant entering the first flow control valve as first flow-control-valve entrance temperature;

flow-control-valve-entrance-temperature control-range determination means for determining control range of the first flow-control-valve entrance temperature, so that the COP value is obtained, in which the difference between the COP value and the maximum COP value, obtained when the first flow-control-valve entrance temperature is varied under predetermined operational conditions, is within a predetermined range; and control means for controlling flow volume of the second coolant flowing in the coolant cooling means, so that the first flow-control-valve entrance temperature estimated by the flow-control-valve-entrance-temperature estimation means is within the control range.

4. The refrigerator as claimed in claim 2, further comprising at least one of pressure-measuring means for measuring pressure of the first coolant between exiting the first flow control valve and entering the first evaporator, and second temperature-measuring means for measuring temperature of the first coolant exiting the first flow control valve, wherein the flow-control-valve-entrance-temperature control-range determination means determines control range of the temperature of the first coolant entering the first flow control valve, using the pressure of the first coolant measured by the pressure-measuring means or the temperature of the first coolant measured by the second temperature-measuring means.

5. The refrigerator as claimed in claim 2, further comprising pressure-measuring means for measuring pressure of the first coolant between exiting the first radiator and entering the first flow control valve, wherein the flow-control-valve-entrance-temperature control-range determination means determines control range of the temperature of the first coolant entering the first flow control valve, using the pressure of the first coolant measured by the pressure-measuring means.

6. The refrigerator as claimed in claim 3, further comprising at least one of pressure-measuring means for measuring pressure of the first coolant between exiting the first flow control valve and entering the first evaporator, and second temperature-measuring means for measuring temperature of the first coolant exiting the first flow control valve, wherein the flow-control-valve-entrance-temperature control-range determination means determines a control range of the temperature of the first coolant entering the first flow control valve, using the pressure of the first coolant measured by the pressure-measuring means or the temperature of the first coolant measured by the second temperature-measuring means.

7. The refrigerator as claimed in claim 3, further comprising pressure-measuring means for measuring pressure of the first coolant between exiting the first radiator and entering the first flow control valve, wherein the flow-control-valve-entrance-temperature control-range determination means determines a control range of the temperature of the first coolant entering the first flow control valve, using the pressure of the first coolant measured by the pressure-measuring means.

8. An air conditioner comprising:

a first compressor for compressing carbon dioxide as a first coolant;

a first four-way valve for switching direction in which the first coolant output from the first compressor flows;

an outdoor heat exchanger for exchanging heat between the first coolant and outdoor air;

a first flow control valve for regulating flow volume of the first coolant; and an indoor heat exchanger for exchanging heat between the first coolant and indoor air;

coolant cooling/heating means for cooling and heating the first coolant, wherein the coolant cooling/heating means includes a second compressor for compressing a second coolant, the second coolant having an energy consumption efficiency higher than that of the first coolant, a second four-way valve for switching direction in which the second coolant output from the second compressor flows, a first heat exchanger for exchanging heat between the second coolant and outdoor air, a second flow control valve for regulating flow volume of the second coolant, and a second heat exchanger for exchanging heat between the first coolant and the second coolant;

heat-exchange-amount control means for controlling quantity of heat exchanged in the coolant cooling/heating means so that a coefficient of performance (COP) value is obtained, in which the difference between the COP value and the maximum COP value obtained when the quantity of heat exchanged in the coolant cooling/heating means is varied under predetermined operational conditions, is within a first predetermined range, wherein when the air conditioner is being operated for cooling, the first coolant is circulated through the first compressor, the outdoor heat exchanger, the coolant cooling/heating means, the first flow control valve, and the indoor heat exchanger, in that sequence, and the second coolant is circulated through the second compressor, the second heat exchanger, the second flow control valve, and the first heat exchanger, in that sequence, when the air conditioner is being operated for warming, the first coolant is circulated through the first compressor, the indoor heat exchanger, the first flow control valve, the coolant cooling/heating means, and the outdoor heat exchanger, in that sequence, and the second coolant is circulated through the second compressor, the second heat exchanger, the second flow control valve, and the first heat exchanger, in that sequence, and the second coolant, in a second refrigeration cycle, has a cooling capacity in a range of from about one-tenth to about one-fifth of cooling capacity of the first coolant in a first refrigeration cycle.

9. A refrigerator comprising:

a first compressor for compressing carbon dioxide as a first coolant;

a first radiator for radiating heat from the first coolant;

a first flow control valve for regulating flow volume of the first coolant;

a first evaporator for evaporating the first coolant;

coolant cooling means for cooling the first coolant and including a second compressor for compressing a second coolant, the second coolant having an energy consumption efficiency higher than that of the first coolant, a condenser for radiating heat from the second coolant, a second flow control valve for regulating flow volume of the second coolant, and a second evaporator for evaporating, with heat from the first coolant, the second coolant;

heat-exchange-amount control means for controlling quantity of heat exchanged in the coolant cooling means, wherein the first coolant is circulated through the first compressor, the first radiator, the coolant cooling means, the first flow control valve, and the first evaporator, in that sequence, the second coolant is circulated through the second compressor, the condenser, the second flow control valve, and the second evaporator, in that sequence, and the second coolant, in a second refrigeration cycle, has a cooling capacity in a range of from about one-tenth to about one-fifth of cooling capacity of the first coolant in a first refrigeration cycle; and first temperature-measuring means for measuring coolant temperature of the first coolant exiting the first radiator, the heat-exchange-amount control means further including:

flow-control-valve-entrance-temperature estimation means for estimating, from the coolant temperature measured by the first temperature-measuring means and the quantity of heat exchanged in the coolant cooling means, temperature of the first coolant entering the first flow control valve as first flow-control-valve entrance temperature, flow-control-valve-entrance-temperature control-range determination means for determining control range of the first flow-control-valve entrance temperature, so that a coefficient of performance (COP) value is obtained, in which the difference between the COP value and the maximum COP value, obtained when the first flow-control-valve entrance temperature is varied under predetermined operational conditions, is within a predetermined range, and control means for controlling flow volume of the second coolant flowing in the coolant cooling means, so that the first flow-control-valve entrance temperature estimated by the flow-control-valve-entrance-temperature estimation means is within the control range.

10. The refrigerator as claimed in claim 9, further comprising at least one of pressure-measuring means for measuring pressure of the first coolant between exiting the first flow control valve and entering the first evaporator, and second temperature-measuring means for measuring temperature of the first coolant exiting the first flow control valve, wherein the flow-control-valve-entrance-temperature control-range determination means determines a control range of the temperature of the first coolant entering the first flow control valve, using the pressure of the first coolant measured by the pressure-measuring means or the temperature of the first coolant measured by the second temperature-measuring means.

11. The refrigerator as claimed in claim 9, further comprising pressure-measuring means for measuring pressure of the first coolant between exiting the first radiator and entering the first flow control valve, wherein the flow-control-valve-entrance-temperature control-range determination means determines a control range of the temperature of the first coolant entering the first flow control valve, using the pressure of the first coolant measured by the pressure-measuring means.

* * * * *